US008277002B2

(12) United States Patent
Perez et al.

(10) Patent No.: US 8,277,002 B2
(45) Date of Patent: Oct. 2, 2012

(54) SELF-CLOSING SLIDE ASSEMBLY WITH DAMPENING MECHANISM

(75) Inventors: Ramiro A. Perez, Chino Hills, CA (US); Ronald J. Judge, Corona, CA (US); Patty J. Brock, Irvine, CA (US)

(73) Assignee: Jonathan Manufacturing Corporation, Irvine, CA (US)

( * ) Notice: Subject to any disclaimer, the term of this patent is extended or adjusted under 35 U.S.C. 154(b) by 345 days.

(21) Appl. No.: 12/684,741

(22) Filed: Jan. 8, 2010

(65) Prior Publication Data

US 2010/0176700 A1 Jul. 15, 2010

Related U.S. Application Data

(60) Provisional application No. 61/143,740, filed on Jan. 9, 2009.

(51) Int. Cl.
*A47B 88/00* (2006.01)

(52) U.S. Cl. ..... 312/333; 312/334.44

(58) Field of Classification Search ..... 312/333, 312/334.44–334.47, 319.1, 334.7, 334.8, 312/334.1; 384/21
See application file for complete search history.

(56) References Cited

U.S. PATENT DOCUMENTS

| | | | | |
|---|---|---|---|---|
| 6,848,759 | B2 | 2/2005 | Doornbos et al. | |
| 7,244,005 | B1 * | 7/2007 | Lu | 312/333 |
| 7,537,296 | B2 | 5/2009 | Leon et al. | |
| 7,588,299 | B2 * | 9/2009 | Yang | 312/334.47 |
| 7,878,606 | B2 * | 2/2011 | Chen et al. | 312/333 |
| 8,083,304 | B2 * | 12/2011 | Hu | 312/333 |
| 2004/0144604 | A1 | 7/2004 | Doornbos et al. | |
| 2004/0183411 | A1 * | 9/2004 | Boks | 312/333 |
| 2007/0001562 | A1 * | 1/2007 | Park | 312/333 |
| 2008/0100190 | A1 * | 5/2008 | Yang et al. | 312/333 |
| 2008/0197759 | A1 * | 8/2008 | Chen et al. | 312/334.1 |
| 2009/0140621 | A1 * | 6/2009 | Yang | 312/319.1 |
| 2009/0189499 | A1 * | 7/2009 | Yang | 312/334.44 |
| 2010/0164340 | A1 * | 7/2010 | Juan et al. | 312/333 |
| 2011/0043087 | A1 * | 2/2011 | Shih et al. | 312/334.1 |

FOREIGN PATENT DOCUMENTS

| | | |
|---|---|---|
| WO | WO 2009 011891 | 1/2009 |
| WO | WO 2009 099554 | 8/2009 |

* cited by examiner

*Primary Examiner* — Janet M Wilkens
(74) *Attorney, Agent, or Firm* — Knobbe, Martens, Olson & Bear, LLP

(57) ABSTRACT

A slide assembly with a self-closing mechanism that includes a dampening mechanism. In one arrangement, the slide assembly includes an inner slide segment slidably coupled to an outer slide segment. The self-closing mechanism is configured to move the inner slide segment towards a retracted position when the inner segment is moved to within a predetermined distance from the retracted position. The slide assembly can also include a latch which is engaged during the closing process and functions to trigger the self-closing and dampening. In an arrangement, the slide assembly has a maximum width dimension of about 0.4 inches or less, taking into account normal manufacturing variations. In an arrangement, a movable portion of the self-closing mechanism slidably engages a bearing race of the outer segment.

24 Claims, 17 Drawing Sheets

SELF-CLOSING SLIDE ASSEMBLY WITH DAMPENING MECHANISM

RELATED APPLICATIONS

This application claims benefit under 35 U.S.C. §119(e) to U.S. Provisional Patent Application No. 61/143,740, filed Jan. 9, 2009, entitled SELF-CLOSING SLIDE ASSEMBLY WITH DAMPENING MECHANISM, the entirety of which is hereby incorporated by reference herein and made part of this specification.

BACKGROUND OF THE INVENTION

1. Field of the Invention

The present invention relates to slide assemblies, and more particularly to compact self-closing slide assemblies with dampening of the self-closing motion.

2. Description of the Related Art

Slide assemblies typically comprise two or more slide segments. In slide assemblies comprising only two slide segments, a first or outer slide segment may be mounted to a frame of a support structure, such as a cabinet or a rack structure, and a second or inner slide segment may be mounted to a movable object, such as a drawer or an internet server, for example. The outer slide segment defines a channel. The inner slide segment is movable in the channel to extend or retract the slide assembly. A bearing assembly may be movably positioned in the channel between the slide segments to facilitate sliding movement of the inner slide segment with respect to the outer slide segment. A three member slide comprises three members, namely an outer, and intermediate, and an inner member. The intermediate member is slidably coupled to the outer member and the inner member is slidably coupled to the intermediate member. Both the intermediate and inner members telescope relative to the outer member. Moreover, the inner member can telescope relative to the intermediate member. Typically the slide inner members are coupled to either side of a movable object, such as a drawer. In some arrangements, the slide assemblies may have multiple intermediate slide members. Bearing assemblies can be positioned between one or more of the slide segments.

In certain situations, drawers may tend to open after they are closed and sometimes drawers do not close completely when they are pushed closed because they are not pushed with sufficient force or they are pushed closed with more force than necessary. When excessive force is used to close a drawer, it can cause the drawer to slam against the cabinet structure and re-open. Also, when drawers are closed with excessive force, it can damage the drawer structure or slide mechanism.

Thus, some slide assemblies include self-closing mechanisms that operate to move the drawer slide to a fully closed position when the slide assembly has been moved to within a particular distance from the fully closed position. However, existing slide mechanisms designed to automatically close a drawer can be bulky and can cause the slide mechanism to take up valuable space within the cabinet or drawer structure, especially in the width direction. Existing mechanisms that control the drawer closing process can also be very complicated and can add significant cost to the slide assembly.

Accordingly, there is a need for an improved slide assembly that avoids some or all of the problems discussed above.

SUMMARY OF THE INVENTION

Accordingly, preferred embodiments of the present invention provide an improved slide assembly with dampened, self-closing motion.

In accordance with one embodiment, a slide assembly for supporting an object is provided comprising at least an outer slide segment and an inner slide segment. The inner slide segment is operably coupled to the outer slide segment, either directly or through one or more intermediate segments. The inner slide segment is moveable relative to the outer slide segment between a fully retracted position and a fully extended position. A self-closing mechanism is secured to one of the segments, preferably the outer slide segment, and the self-closing mechanism configured to engage the other segment, preferably the inner slide segment, and automatically move the inner slide segment into the fully retracted position when the inner slide segment is moved to within a predetermined distance from the fully retracted position. The self-closing mechanism includes a dampener configured to dampen the closing motion of the self-closing mechanism. The slide assembly preferably has a maximum width dimension that is about 0.4 inches or less, taking into account normal manufacturing variations. In one embodiment, the desired tolerance range may be +/−0.03 inches. Thus, the maximum width dimension may be about 0.43 inches in some cases.

In accordance with another embodiment, a slide assembly for supporting an object is provided, comprising an outer slide segment and an inner slide segment. The inner slide segment is operably coupled to the outer slide segment, either directly or through one or more intermediate segments. The inner slide segment is moveable relative to the outer slide segment between a fully retracted position and a fully extended position. A self-closing mechanism is secured to one of the segments, preferably the outer slide segment, and a movable portion of the self-closing mechanism is configured to engage the other segment, preferably the inner slide segment, and automatically move the inner slide segment into the fully retracted position when the inner slide segment is moved to within a predetermined distance from the fully retracted position. The self-closing mechanism includes a dampener configured to dampen the closing motion of the self-closing mechanism. The movable portion of the self-closing mechanism slidably engages a bearing surface of the one segment, preferably the outer segment.

A slide assembly includes a first slide segment and a second slide segment. The first slide segment defines a wall portion and a pair of bearing surfaces spaced from one another on opposite sides of the wall portion. The second slide segment is operably supported by the bearing surfaces of the first segment. The second slide segment is movable relative to the first slide segment between an extended position and a retracted position. A self-closing mechanism is coupled to the first slide segment and automatically moves the second slide segment in a closing direction towards the retracted position when the second segment is moved to within a predetermined distance from the retracted position. The self-closing mechanism includes a carrier configured with surfaces that engage the bearing surfaces to support the carrier relative to the second slide segment. The carrier is movable relative to the first segment. A pin is carried by the carrier and is rotatable relative to the carrier. A pair of springs urges the carrier in the closing direction. A dampener is coupled to the carrier and produces a dampening force tending to oppose the movement of the carrier. A guide slot is defined by the wall of the first slide segment and guides the movement of the pin. An engagement surface is defined by the second slide segment and releases the pin from a set position and engages the pin such that the second segment is moved along with the movement of the carrier towards a closed position as the carrier is urged by the springs against the dampening force of the dampener.

A slide assembly includes an outer slide segment and an inner slide segment. The outer slide segment defines a wall portion and a pair of bearing surfaces spaced from one another on opposite sides of the wall portion. An inner slide segment is operably supported by the bearing surfaces of the outer segment. The inner slide segment is movable relative to the outer slide segment between an open position and a closed position. A self-closing mechanism is coupled to the outer slide segment and configured to automatically move the inner slide segment in a closing direction towards the closed position when the inner segment is moved to within a predetermined distance from the closed position. The self-closing mechanism includes a carrier that is slidably supported relative to the outer slide segment by the bearing surfaces. A latch is carried by the carrier, wherein the latch selectively engages the inner slide segment such that the carrier and the inner slide segment move together relative to the outer slide segment. A biasing mechanism urges the carrier in the closing direction. A dampener produces a dampening force tending to oppose movement of the carrier. A guide slot is defined by the wall of the outer slide segment and assists in engagement and disengagement of the latch from the inner slide segment.

A slide assembly includes a first slide segment defining at least one bearing surface and a second slide segment operably supported by the bearing surface of the first slide segment. The second slide segment is able to move relative to the first slide segment between a closed position and an open position. A self-closing mechanism automatically moves the second slide segment in a closing direction towards the closed position when the second segment is moved to within a predetermined distance from the closed position. The self-closing mechanism includes a carrier that engages the second slide segment and a dampener that dampens the motion of the carrier. The carrier is slidably supported by the bearing surface of the first slide segment.

In accordance with one embodiment, the closing mechanism includes a movable latch assembly which engages a slot on the inner segment. One or more springs are configured to provide tension between the outer segment and the latch assembly. A dampener is configured to provide a dampening effect to the self-closing motion between the latching assembly and the outer segment.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of the embodiments summarized above are intended to be within the scope of the invention herein disclosed. However, despite the foregoing discussion of certain embodiments, only the appended claims (and not the present summary) are intended to define the invention. The summarized embodiments, and other embodiments of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENTS

In the following detailed description, terms of orientation such as "top," "bottom," "upper," "lower," "front," "frontward," "rear," "rearward," and "end" are used to simplify the description of the context of the illustrated embodiments. Likewise, terms of sequence, such as "first" and "second," are used to simplify the description of the illustrated embodiments. However, other orientations and sequences are possible, and the present invention should not be limited to the illustrated orientation(s). Those skilled in the art will appreciate that other orientations of the various components are possible.

Figure 1:
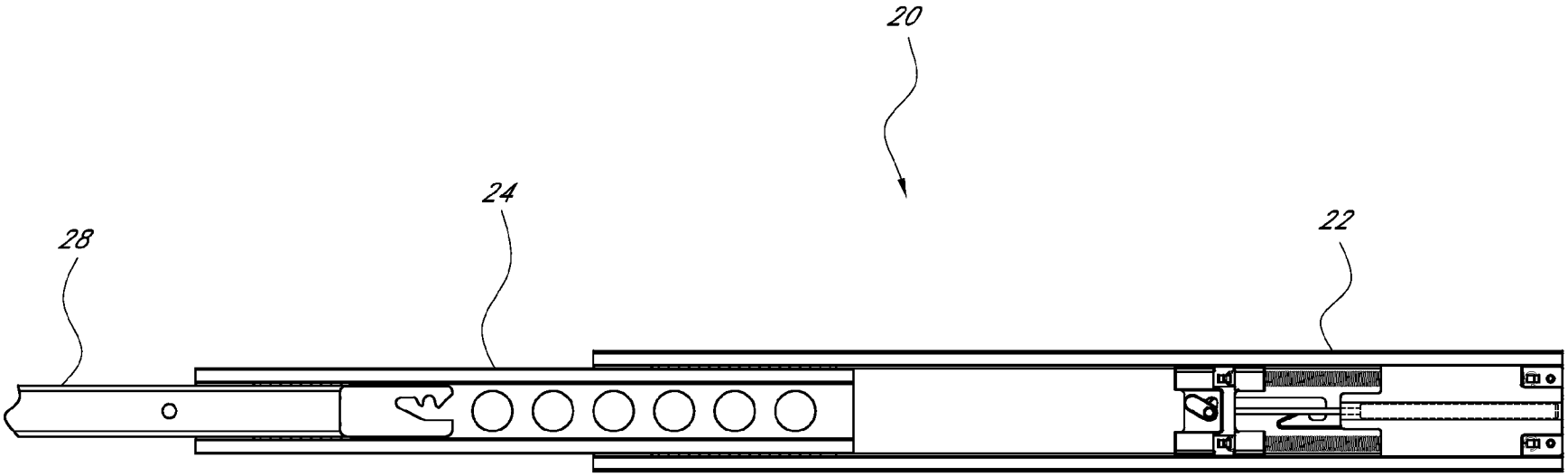
FIG. 1 is an elevational view of one embodiment of a self-closing slide assembly.

FIG. 1 illustrates an embodiment of a slide assembly 20 including an outer slide segment 22 and an inner slide segment 28 operably supported by the outer segment 22. The illustrated slide assembly 20 also includes an intermediate segment 24 interposed between the outer slide segment 22 and the inner slide segment 28. In other arrangements, the slide assembly 20 can include one or more intermediate segments 24 interposed between the inner and outer segments 22, 28 or the slide assembly may omit any intermediate segments 24. Thus, in some embodiments, the inner slide segment 28 is directly supported by the outer segment 22 (not withstanding any bearing assemblies) and in other embodiments the inner slide segment 28 is supported through an intermediate segment 24. Regardless of the arrangement, the inner slide segment 28 is movable relative to the outer slide segment 22.

The sliding contact between the slide segments can be direct bearing surface contact or there can be bearing assemblies 29 between the segments. The bearing assemblies 29 may include a carrier and a plurality of ball bearings, or other suitable types of bearings. The carriers space the bearings from one another. The bearing assemblies 29 securely couple the segments together in a slidable configuration. Bearings allow the segments to smoothly slide with relation to one another and reduce friction. However, in other embodiments, the slide assembly segments can be coupled together with rollers or other friction decreasing devices.

The segments 22, 24, 28 telescopically engage one another such that the slide assembly 20 can be extended and retracted. For example, the slide assembly 20 can be retracted into a fully closed position, or extended into a fully open position. One or both of the open and closed positions may be determined by the slide assembly 20 itself, or may be determined by the objects to which the slide assembly 20 is operably connected. For example, in some installations, the objects to which the slide assembly 20 is connected may limit movement of the slide assembly 20, such as inhibiting the slide assembly 20 from moving to an open (or closed) position that might otherwise be possible if the slide assembly 20 was in an uninstalled condition.

As disclosed above, in the illustrated arrangement, the intermediate segment 24 is slidably supported by the outer segment 22 and the inner segment 28 is slidably supported by the intermediate segment 24. Both the intermediate segment 24 and inner segment 28 can telescope relative to the outer segment 22. Moreover, the inner segment 28 can telescope relative to the intermediate segment 24. One bearing assembly 29 (only one shown in FIG. 3A) is interposed between the inner segment 28 and the intermediate segment 24 and another bearing assembly 29 is interposed between the intermediate segment 24 and the outer segment 22. As will be understood by those skilled in the art, the bearing assemblies 29 also assist in the timing of the movement between the various slide segments 22, 24, 28. In a preferred embodiment, the segments 22, 24, 28 are made of aluminum which is lighter than other common metals. However, in other embodiments the segments can be made of steel, plastic, or any other durable material.

Typically the outer segment 22 is coupled to either side of a cabinet (or other support structure) and the inner segment 28 is coupled to the drawer in a manner that allows the drawer to slide in and out of the cabinet. Embodiments of the slide assembly are discussed in the context of drawers and cabinets, but it is suitable for many uses and applications involving one object that moves relative to another.

Figure 3A:
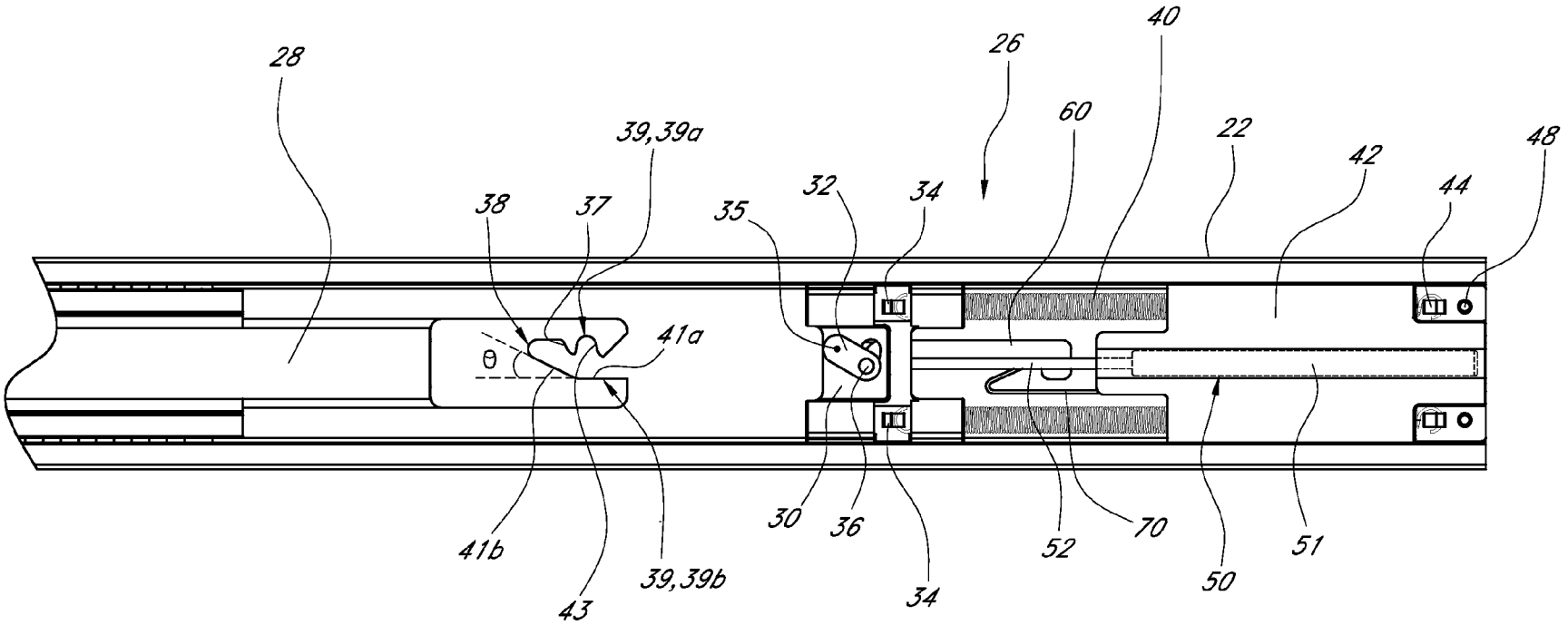
FIG. 3A is an elevational view of a portion of the self-closing slide assembly of FIG. 1.
Figure 3B:
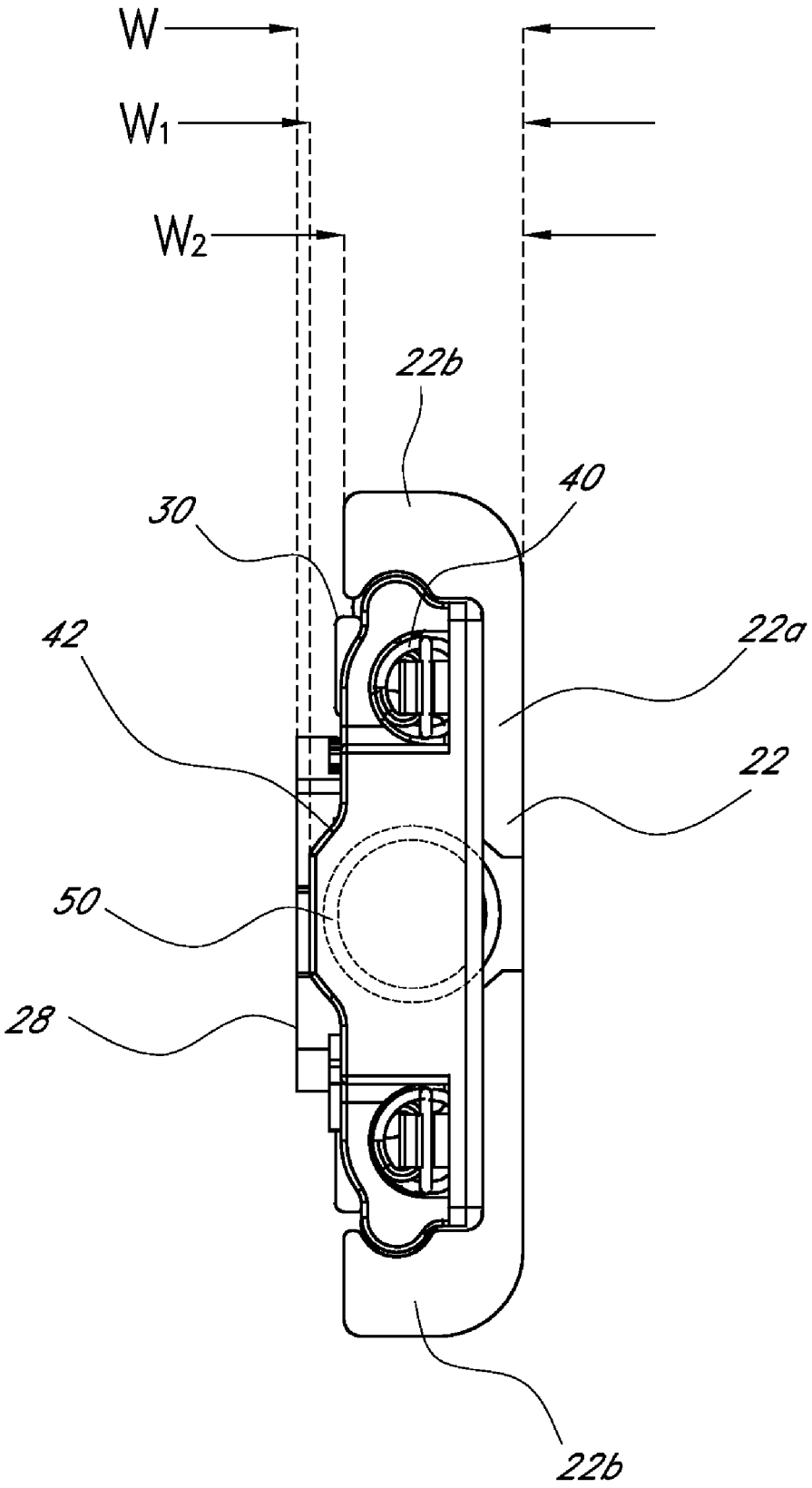
FIG. 3B is an end view of the self-closing mechanism and slide assembly of FIG. 1.

With reference to FIG. 3B, the outer segment 22 defines a wall portion 22*a* and a spaced pair of bearing portions 22*b*. The wall portion 22*a* extends in a generally vertical direction (in the orientation as shown) and the bearing portions 22*b* are spaced from one another on opposite sides of the wall portion 22*a*. Each of the bearing portions 22*b* defines a bearing surface that faces inward towards the other. A self-closing mechanism 26 (described below), along with the inner and intermediate members 24, 28 fit within an area and a width W defined by the slide assembly 20 such that the total width of the slide assembly 20 is advantageously kept to a minimum. That is, the self-closing mechanism doesn't protrude from an outer envelope or width W defined by the outer segment 22, as least to any significant extent, in contrast to prior art designs. Accordingly, the slide assembly 20 is not required to be any larger, or at least not significantly larger, in cross-sectional width W than it would be without the self-closing mechanism 26. In many applications, reducing the overall width W of the slide assembly 20 is an important design criterion and is a particularly advantageous characteristic in the marketplace. In a preferred embodiment the overall thickness or width W of the slide assembly 20 is preferably less than about 0.4 inches, taking into account normal manufacturing variations. A desirable tolerance range may be about +/−0.03 inches. Accordingly, in one arrangement, the width W of the slide assembly 20 may be about 0.43 inches or less, or about 0.37 inches or less. In other applications, the width dimension may be lesser or greater than 0.4 inches.

As shown in FIG. 3A, the slide assembly 20 preferably includes a self-closing mechanism 26 that operates to move the inner slide segment 28 towards a fully closed position once the inner slide segment 28 has been moved to within a predetermined distance of the closed position. In the illustrated embodiment, the self-closing mechanism 26 is secured to the outer segment 22 via fasteners 48. The fasteners can be, for example, a screw, bolt, pin or, as illustrated, a rivet. Although two fasteners are shown, a single fastener or more than two fasteners can be used. Moreover, any suitable type of fastener or other coupling mechanism can be used.

The self-closing mechanism 26 includes a dampener 50 that is operable to dampen movement of the self-closing mechanism 26. In particular, the dampener 50 produces a dampening force that tends to resist movement of the self-closing mechanism 26 at least in the closing direction. The dampener 50 may also produce a dampening force that tends to resist movement of the self-closing mechanism 26 in the opening direction, which may be less than, equal to or greater than the dampening force in the closing direction. In some arrangements, no or substantially no dampening force is produced in the opening direction.

The dampener 50 is operably positioned between a movable carrier 30 and the outer segment 22. In particular, the dampener 50 is coupled to a dampener mount 42 which is coupled to the outer segment 22 via the fasteners 48. The dampener 50 includes a dampener cylinder 51 and a dampener rod 52, which can move slidably in and out of the dampener cylinder 51. The dampener cylinder 51 is coupled to the dampener mount 42. The dampener rod 52 is coupled to the carrier 30 which is slidably supported by the outer segment 22. In the illustrated arrangement, the carrier 30 includes surfaces that engage the bearing surfaces of the outer segment 22 and allow the carrier 30 to slide relative to the outer segment 22. Preferably, the dampener mount 42 also includes portions that engage the bearing surfaces of the outer segment 22, which assist the fastener(s) 48 in securing the dampener mount 42 relative to the outer segment 22. Therefore, the fasteners 48 can be located only at one (a rearward) end of the dampener mount 42, which reduces the total number of components and simplifies the assembly process.

A latch 32 is rotatably or pivotally coupled to the carrier 30. The carrier 30 also includes at least one hook 34 to which a spring 40 can be coupled. In the illustrated embodiment, a pair of springs 40 are provided, which are coupled to the latch carrier 30 and the dampener mount 42. One end of each spring 40 is coupled to the hooks 34 on the latch carrier 30 and the other end of each spring is coupled to a hook 44 on the dampener mount 42. Therefore, a tension force is applied to the carrier 30 which tends to urge the carrier 30 in the closing direction towards the dampener mount 42 and the closed position. Preferably, the dampener 50 is generally aligned with a center longitudinal axis of the slide assembly 20 and positioned between the springs 40 so as to provide a balanced force to the carrier relative to the longitudinal axis and reduce unwanted friction. Preferably, the dampener mount 42 also acts as a cover or housing to envelope and protect at least a portion of the springs 40 and dampener 50. As illustrated, preferably the entire dampener cylinder 51 is housed between the dampener mount 42 and the outer slide segment 22.

Although not shown, the latch carrier 30 includes one or more bumper assemblies that contact a portion of the inner segment 28 when the inner segment 28 engages the latch 32. The bumper assemblies can be configured in this manner so that all of the force from the inner segment 28 is not transferred to the latch 32 or pin 36, but is also partially absorbed by the bumper assemblies. Such an arrangement is disclosed in U.S. Provisional Patent Application No. 61/143,740, which has been incorporated by reference herein in its entirety. The specific portions of application No. 61/143,740 discussing the bumper assemblies, including but not limited to FIGS. 3 and 4 and paragraph [0024], are again incorporated by reference herein.

The inner segment 28 includes a rearward end with a slot 38. The slot 38 is defined between a top portion and a bottom portion of the end of the inner segment 28. The slot 38 opens to the rearward end of the inner segment 28. The top portion and bottom portion of the rearward end of the inner segment 28 cooperate to define a surface 39 that defines the slot 38. The surface 39 includes an upper surface portion 39*a* and a lower surface portion 39*b*. Preferably, the upper surface portion 39*a* of the slot 38 defines a first tooth 37 and a second tooth 43. The inner segment 28 is configured so that the slot 38 is aligned with the pin 36 in a direction perpendicular to the longitudinal axis of the slide assembly 20. Preferably, the latch 32 is rotatably coupled to the carrier 30 and rotates about an axis 35. The latch 32 can also include a pin 36 which is configured to engage or be movable within the slot 38. The slot 38 is configured to receive the pin 36 on the latch 32 when the inner segment 28 in moved towards the closed position. The lower surface portion 39*b* and the second tooth 43 define an opening through which the pin 36 is received into the slot 38. At its opening, the lower surface portion 39*b* of the slot 38 includes a horizontally flat portion 41*a* that is parallel to the longitudinal axis of the slide assembly 20 so that the pin 36 can enter the slot and move horizontally within the slot 38. The lower surface portion 39*b* of the slot 38 also includes a sloped portion 41*b* rearward of the flat portion 41*a*. The sloped portion 41*b* slopes upward at an angle θ relative to the longitudinal axis and the flat portion 41*a* of the lower surface portion 39*b*. The sloped portion 41*b* is configured to engage the pin 36 and cause it to move upward into the closed end of the slot 38. Preferably, the angle θ between the sloped portion 41 and horizontal, as defined by the bottom portion at the opening, is between about 25 and 27 degrees. More preferably, the angle θ is between about 25.5 and 26.5 degrees. In one preferred embodiment, the angle θ is about 26 degrees.

In the illustrated embodiment, the outer segment 22 includes a guide slot 60 within which the pin 36 is restrained to move. The pin 36 preferably extends through an opening in the carrier 30 and into the guide slot 60. As illustrated, the pin 36 also extends in the other direction, away from the outer segment 22, so that it can be engaged by the surface 39 of slot 38 of the inner slide segment 28. The guide slot 60 is defined by the wall portion 22*a* of the outer slide segment 22. The guide slot 60 can be machined (or methods of material removal) out of a section of the outer member 22 so that no additional parts are needed to define a guide slot and space (e.g., width) is conserved. The self-closing mechanism 26 can also include a reset spring 70 adjacent to the guide slot 60.

FIG. 3B illustrates an end view of the slide assembly 20 and self-closing mechanism 26 of FIG. 3A. As disclosed above, the slide assembly 20 defines a width W within which the self-closing mechanism 26 fits. The outer side edge of the outer segment 22 and the opposite outward-most surface of the self-closing mechanism 26 define a width $W_1$ that is equal to or, preferably, less than the width W of the slide assembly 20. The outer segment 22 defines area width $W_2$ in which most of the self-closing mechanism 26 is contained. In the illustrated arrangement, the width $W_1$ is slightly greater than the width $W_2$ (by about 25% or less, or preferably about 16.5% or less). In one preferred embodiment, without limitation, $W_1$ is approximately 0.368 inches and $W_2$ is approximately 0.316 inches. The dampener mount 42 is supported by the outer segment 22 and is configured to at least partially contain the springs 40 and dampener 50. The carrier 30 is also supported by the outer segment 22 at the bearing surfaces. The inner segment 28 can be directly supported by the bearing surfaces of the outer segment 22 or it can be indirectly supported by the outer segment 22 through additional segments. In a preferred embodiment, the entire self-closing mechanism 26 and its parts are coupled to or substantially or entirely encompassed within the segments 22, 24, 28. The dampener 50, springs 40, and dampener mount 42 can all be substantially or entirely accommodated within a space defined by the outer segment 22. The total width W of the slide assembly 20 and self-closing mechanism is minimal because the most of the parts of the self-closing mechanism fit within the area defined by the outer segment 22.

Figure 2:
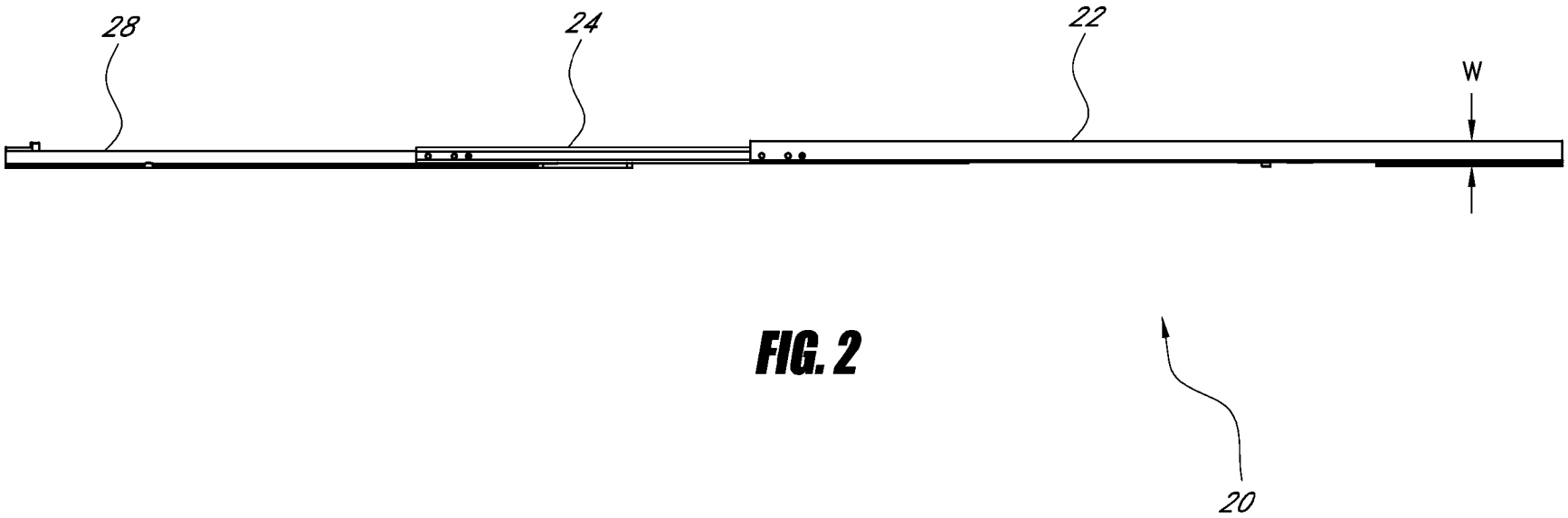
FIG. 2 is a top view of the self-closing slide assembly of FIG. 1.
Figure 4:
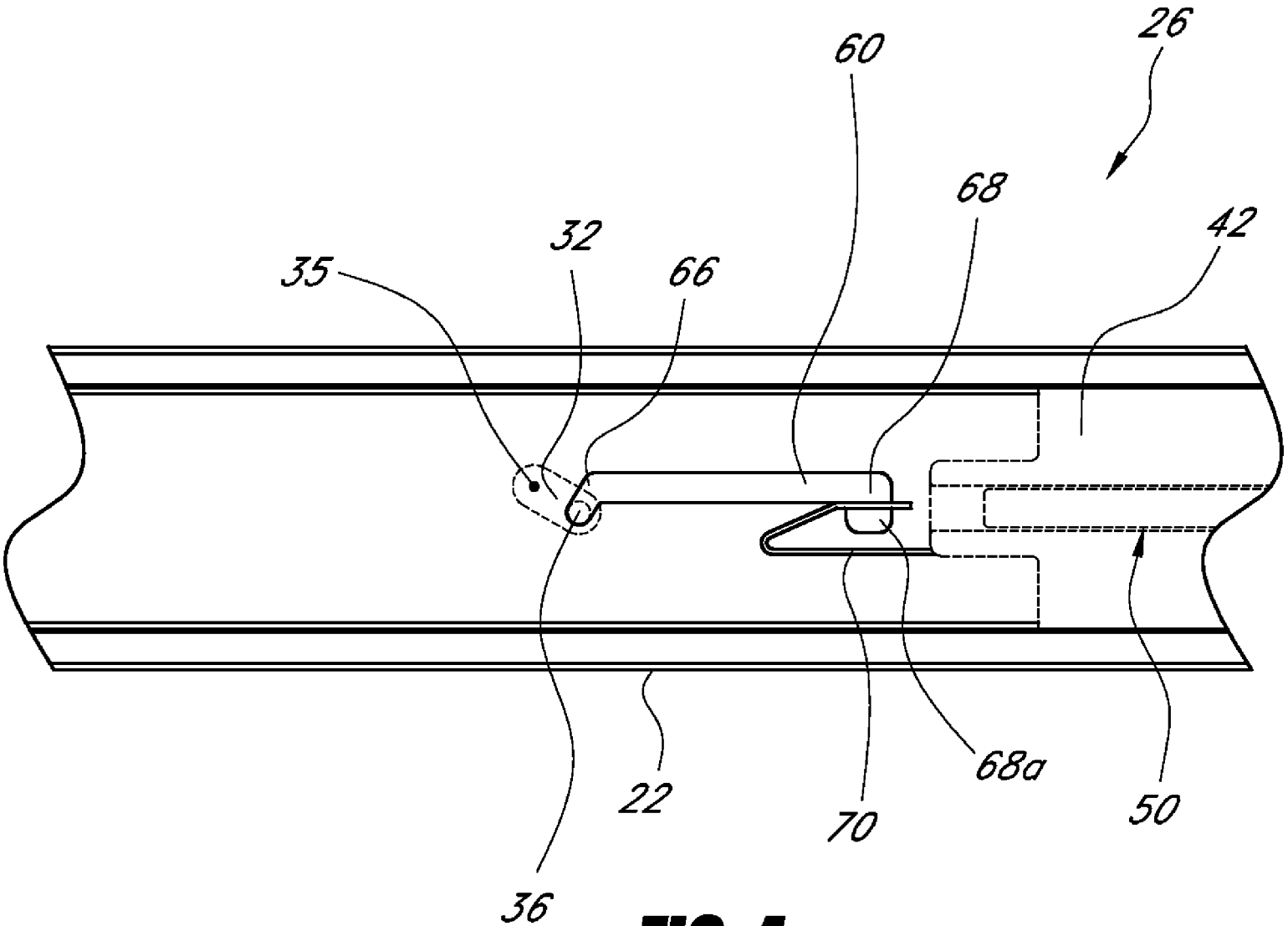
FIG. 4 illustrates the self-closing mechanism of FIG. 1 with certain parts removed.

FIG. 4 illustrates the self-closing mechanism 26 of FIGS. 1-3 with certain parts removed. As illustrated, the outer segment 22 includes the guide slot 60 which is cut away from the outer segment 22. The pin 36 is movable within the guide slot 60 and can move generally toward or away from the dampener 50. For the most part the guide slot 60 is straight or linear and guides the pin 36 along the longitudinal axis, in the illustrated orientation. However, the guide slot 60 can include portions that change the direction of the pin 36 or lock the pin 36 in place. Preferably, the guide slot 60 includes a locking portion 66 in which the pin 36 can be securely held against the force applied by the springs 40. The locking portion 66 is preferably located at the forward end portion of the guide slot 60 closest to the inner segment 28 to hold the latch carrier 30 in an extended or open position. The locking portion 66 extends from the linear portion of the guide slot 60 in a direction having at least a component perpendicular to the longitudinal axis of the slide assembly 20.

The guide slot 60 preferably includes a rearward end portion 68 at which the pin 36 is positioned when slide assembly 20 is fully closed and the inner slide segment 28 is in the closed position. A reset spring 70 is coupled adjacent to the end portion 68 of the guide slot 60. The reset spring 70 is preferably held in place by the damper mount 42, but it can also be coupled to the outer segment 22 or the damper 50. At least a portion of the reset spring 70 is configured to be movable in relation to the guide slot 60 and the outer segment 22. The reset spring 70 normally biases pin 36 out of recess 68*a* and is able to flex to permit pin 36 to enter recess 68*a*. The recess 68*a* extends from the linear portion of the guide slot 60 in a direction having at least a component perpendicular to the longitudinal axis of the slide assembly 20.

Figure 5A:
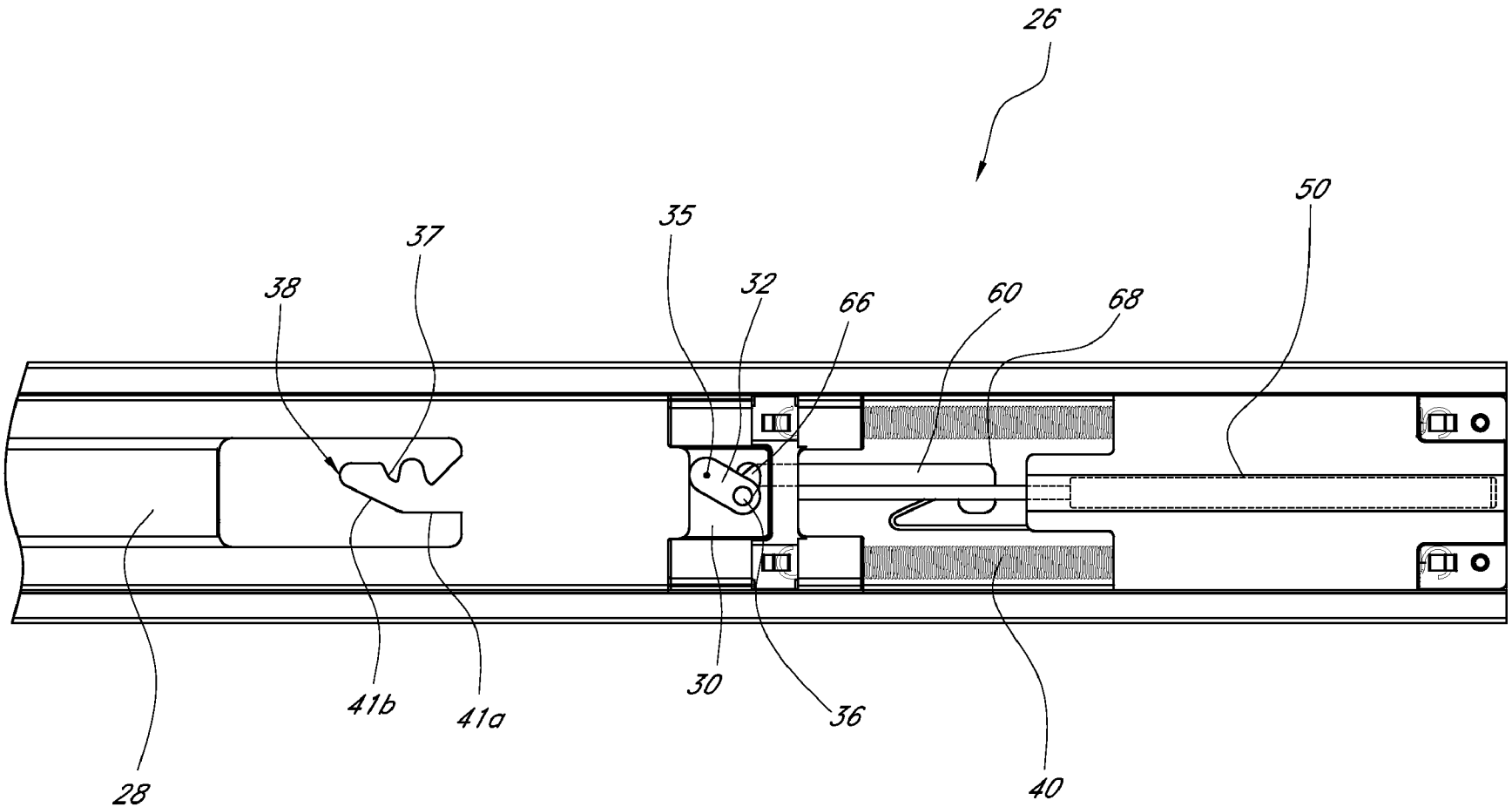
FIGS. 5A-F illustrate the interaction between an inner slide segment and a self-closing mechanism in the slide assembly of FIGS. 1-4, during opening and closing of the slide assembly.

FIGS. 5A-F illustrate the interaction between the inner segment 28 and the self-closing mechanism 26 of FIGS. 1-4. FIGS. 5A-F show the self-closing mechanism 26 and the inner segment 28 in several relative positions labeled A-F. In FIG. 5A the latch 32 and pin 36 are biased in a "set" position and the inner segment 28 is in a partially open position away from the self-closing mechanism 26. With the inner segment 28 and the slot 38 pulled away from the latch 32, the pin 36 remains in the locking portion 66 of the guide slot 60 and the carrier 30 and dampener rod 52 remain in an extended position away from the dampener 50. In the illustrated "set" position, the springs 40 are in tension.

Figure 5B:
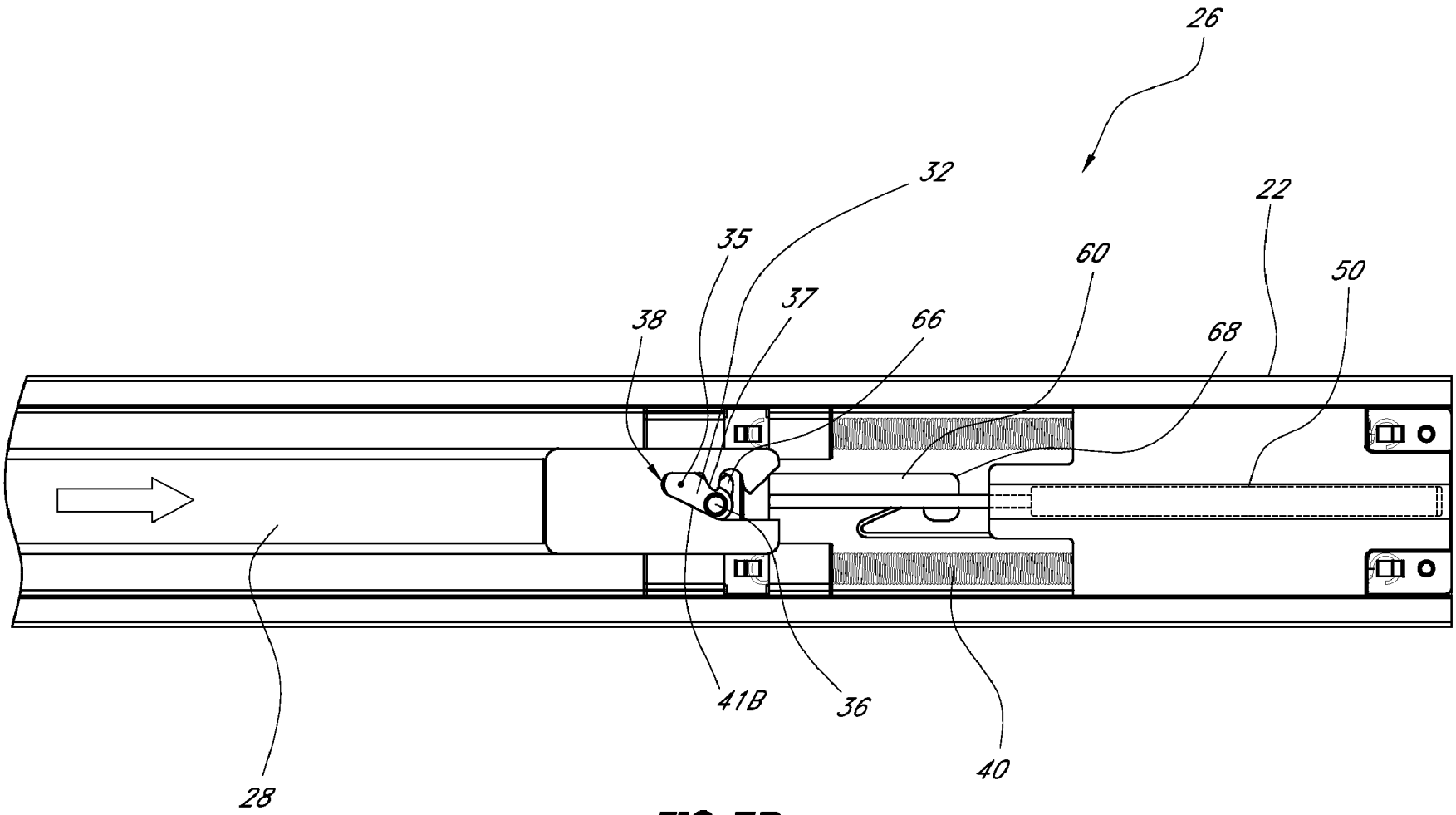
Figure 5C:
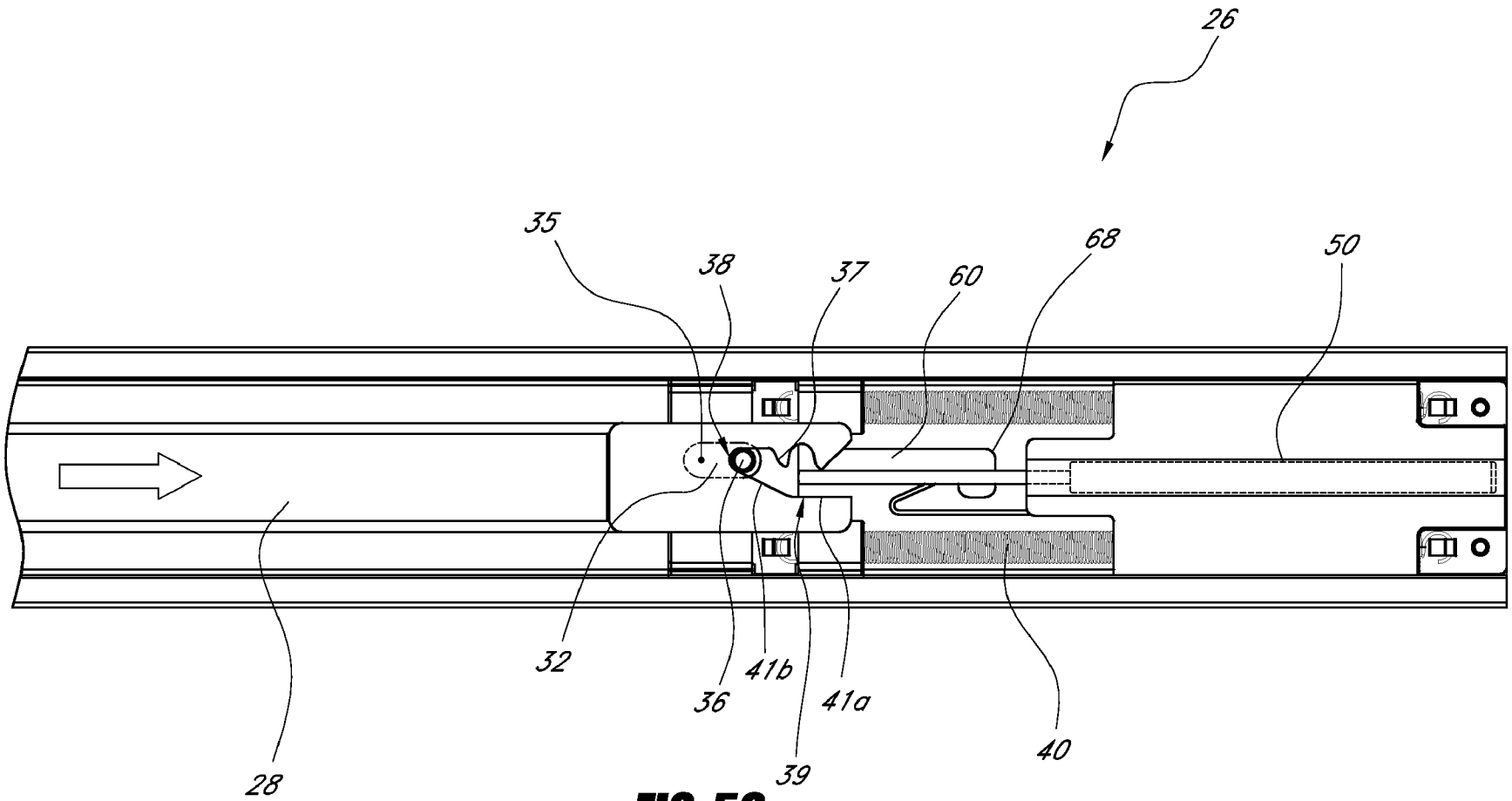
Figure 5D:
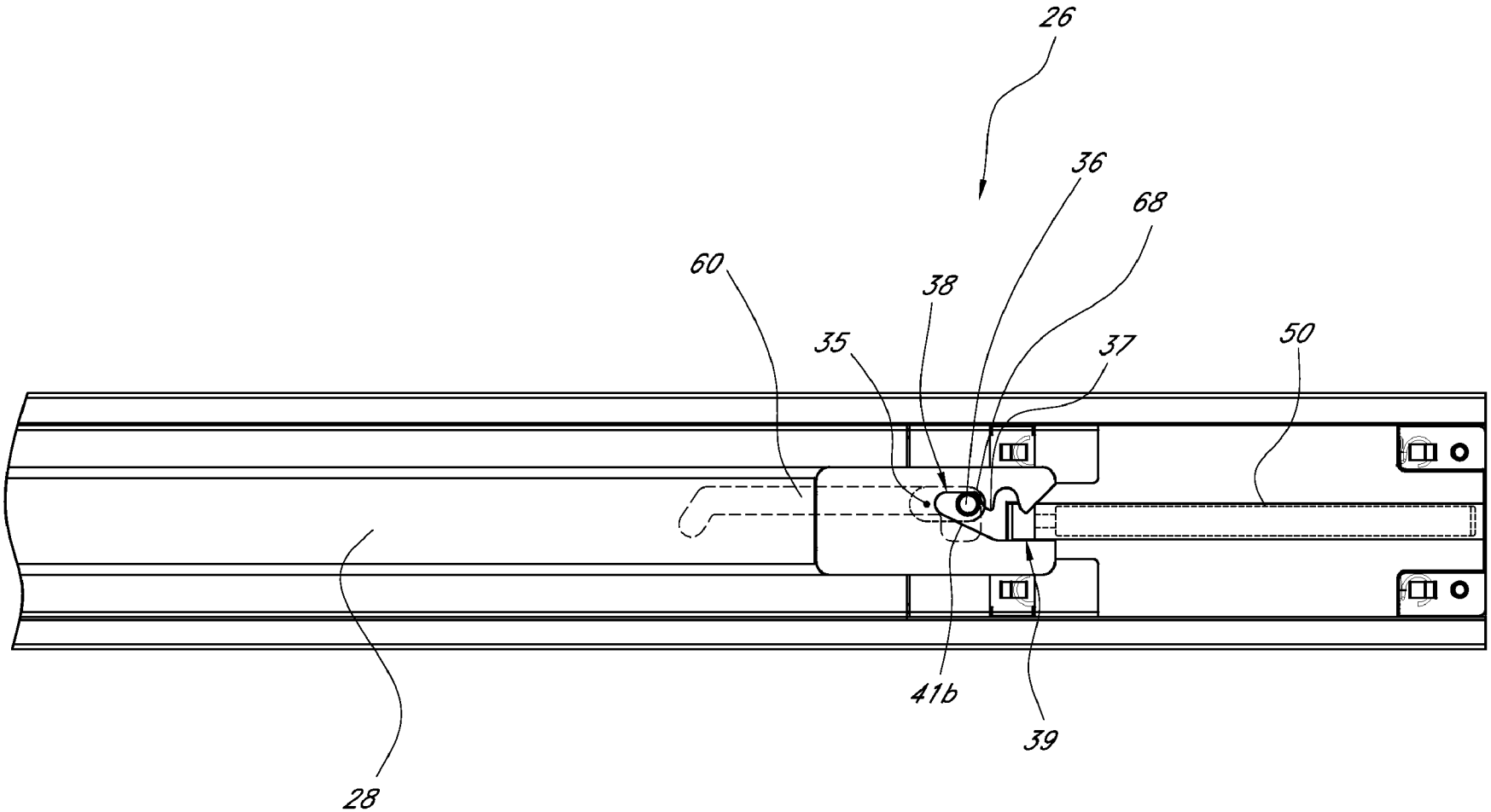

The inner segment 28 can be moved in relation to the outer segment 22 in the closing direction towards the self-closing mechanism 26 until the inner segment 28 engages and moves the pin 36, which begins the self-closing operation. Preferably, the self-closing operation occurs at a point where the drawer or assembly is almost closed or within a desirable distance from the fully closed position, which may vary depending on the intended application. As the inner segment 28 is moved in the closing direction towards the dampener 50 and the rearward end of the outer segment 22, the pin 36 enters the slot 38, as shown in FIG. 5B. Preferably, at this point, the latch 32 is angled relative to the longitudinal axis of the slide assembly 20. In particular, the pin 36 is below (in the orientation of FIG. 5B) the axis 35 of the latch 32. As the inner segment 28 is moved further in the closing direction (as indicated by the arrow in FIG. 5B), the sloped portion 41*b* of the slot 38 and/or the shape of the slot 38 forces the pin 36 upward and out of the locking portion 66 of the guide slot 60. The pin 36 is then moved into a position in which it can slide within the linear portion of the guide slot 60, as shown in FIG. 5C. Then the tensioned springs 40 pull the latch carrier 30 in the closing direction and the dampener rod 52 slides further into the dampener 50 resulting in a dampening force being produced. The inner segment 28 is also pulled in the closing direction as the pin 36 engages the first tooth 37 of the slot 38. The first tooth 37 is preferably configured so that it is securely engaged by the pin 36 when the pin 36 moves within the linear portion of the guide slot 60, and so that the pin 36 cannot move past or around the first tooth 37 while in the linear portion of the guide slot 60. As the pin 36 and carrier 30 move toward the dampener 50 and the rearward end of the outer segment 22, the pin 36 pulls the inner segment 28 along with it in the closing direction towards the closed position. The force of the springs 40 pulling on the latch carrier 30 is countered by the dampening force of the dampener 50 so that the inner segment 28 moves toward a closed position in a controlled manner. The springs 40 pull the latch carrier 30 and move the pin 36 until the inner segment 28 has reached its fully closed position, as illustrated in FIG. 5D. In this arrangement, the fully closed position is defined when the pin 36 reaches the end of the linear portion of the guide slot 60. However, in other arrangements, the pin 36 may stop short of the end of the linear portion of the guide slot 60.

The dampener 50 prevents the slider or assembly from retracting with excessive speed or force. Even if a user attempt to use excessive force in pushing the drawer closed, the dampener 50 may prevent slamming and reopening. Preferably, the dampener 50 is an oil dampener, but in other embodiments the dampener could be an air dampener, an elastomeric dampener, or any other suitable type of dampener. One suitable oil dampener is sourced from Shanghai Henovo Industries Co. Ltd. located in Shanghai, China.

As illustrated in FIG. 5D, in the fully closed position, the springs 40 remain in tension and provide a force tending to resist the carrier 30 and the inner segment 28 from moving away from to the rearward end of the outer segment 22 in the opening direction towards the open position. In one embodiment, a portion of the guide slot 60 can be configured to assist in keeping the mechanism in the closed position, such as employing a portion similar to the locking portion 66 (FIG. 4).

Figure 5E:
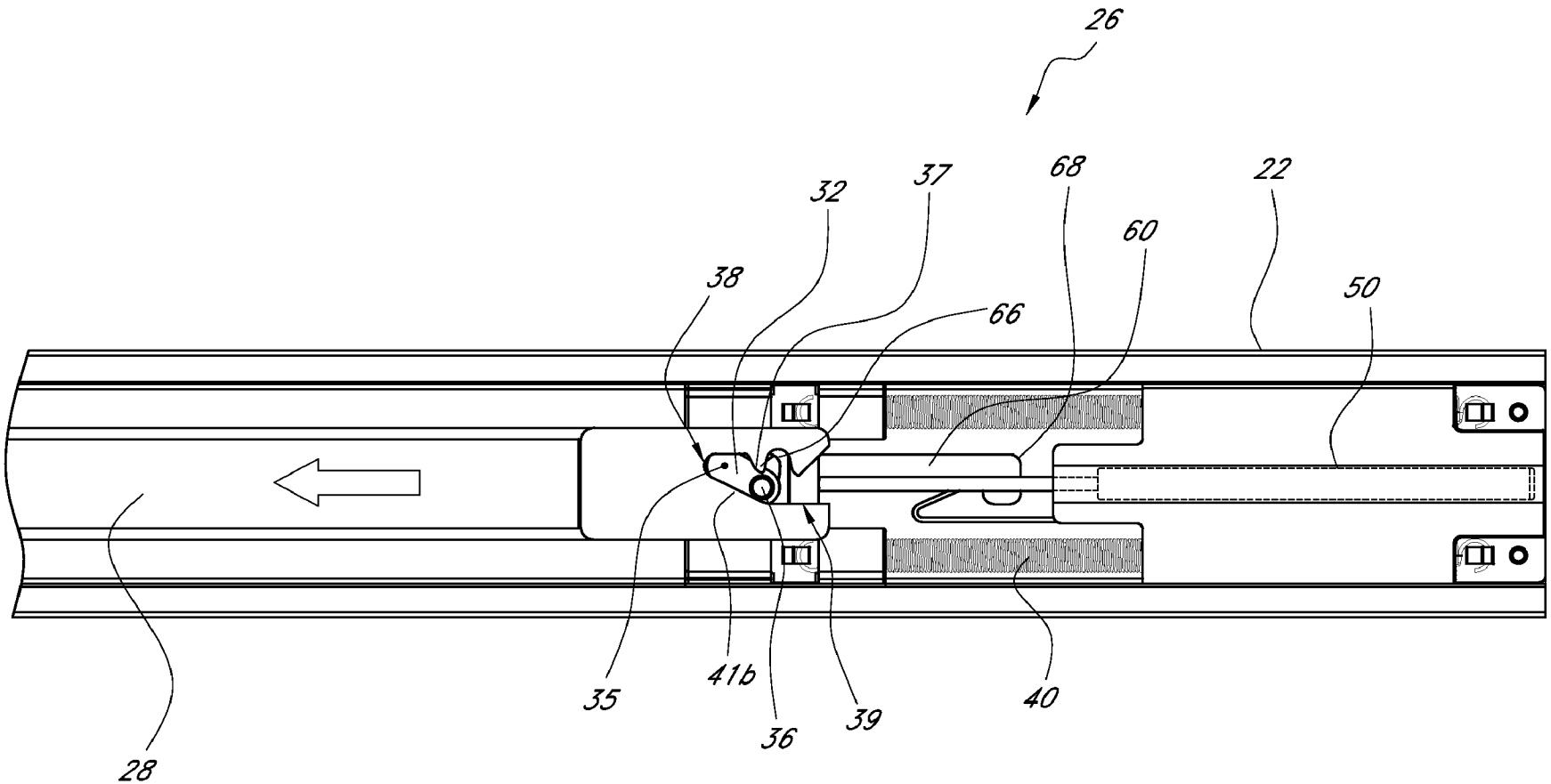

When a user opens the drawer or pulls the inner segment 28 in an opening direction away from the rearward end of the outer segment 22 and the closed position, the first tooth 37 of the slot 38 engages and moves the pin 36 away from the dampener 50. As the pin 36 moves through the guide slot 60, the latch carrier 30 is moved away from the rearward end of the outer segment 22, thereby extending the dampener 50 and stretching the springs 40. The dampener 50 may be configured to provide less dampening force when opening (extending) than when closing (retracting). In one embodiment, the dampener 50 is configured to provide no dampening force when the slide assembly 20 is opening. During opening of the slide assembly 20, the inner segment 28 continues to move away from the rearward end of the outer segment 22 until the pin 36 reaches the locking portion 66 of the guide slot 60, as shown in FIG. 5E. The shape of the guide slot 60 and the first tooth 37 of the slot 38 assists in moving the pin 36 into the locking portion 66 as the pin 36 slides downward and disengages from the first tooth 37.

Figure 5F:
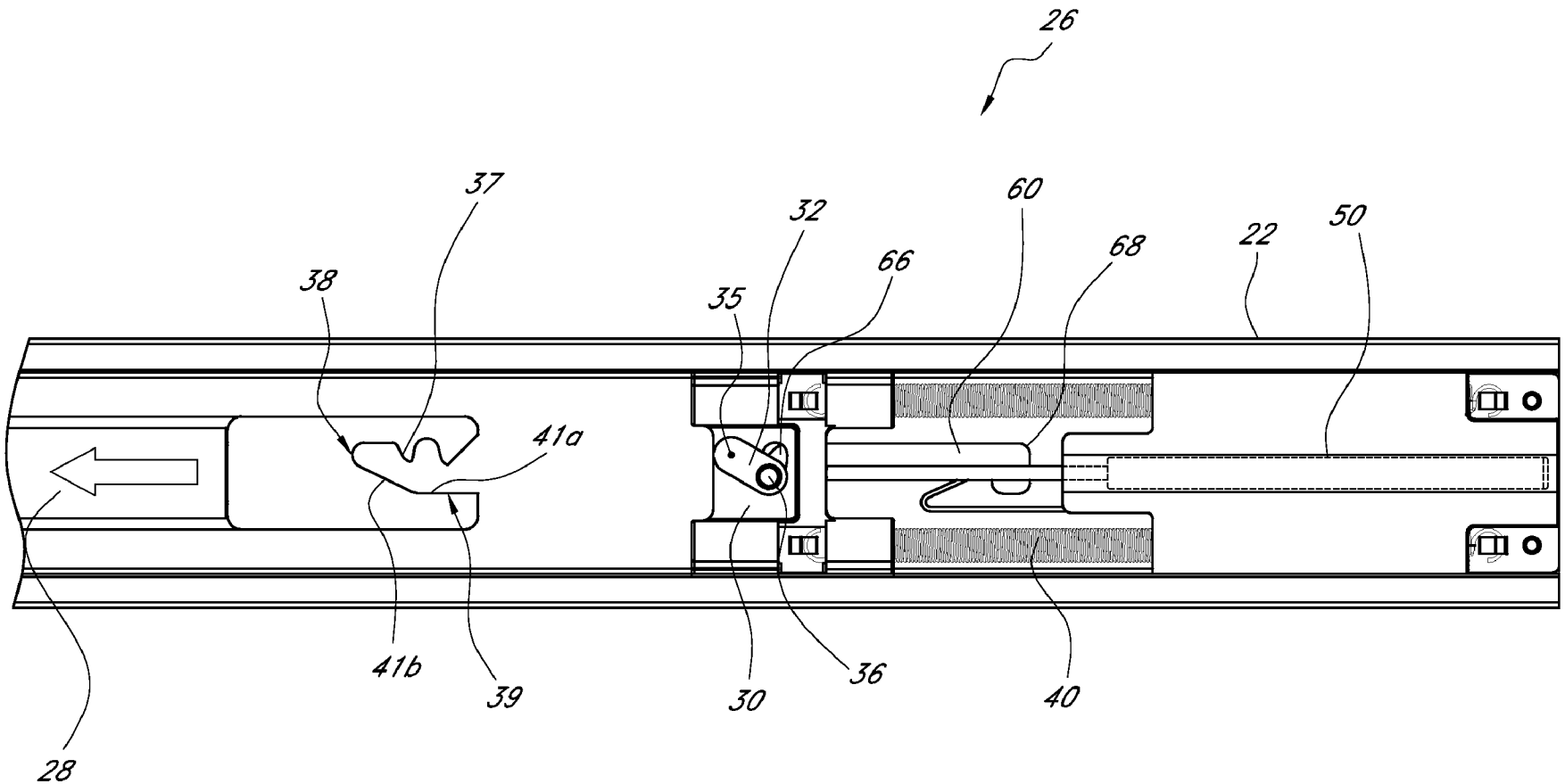

As the inner segment 28 is moved even further away from the dampener 50, the pin 36 slides out of the slot 38. The pin 36 remains secured in the locking portion 66 of the guide slot 60 and holds the carrier 30 in the extended or open position against the tension provided by the spring(s) 40, as shown in FIG. 5F. At this point, the self-closing mechanism 26 has reached its "set" position and will typically remain in the "set" position until engaged again by the inner segment 28 and slot 38. With this arrangement, slide assembly 20 is functional in the orientation of FIGS. 5A-F or upside down compared to the orientation of FIGS. 5A-F.

Figure 6A:
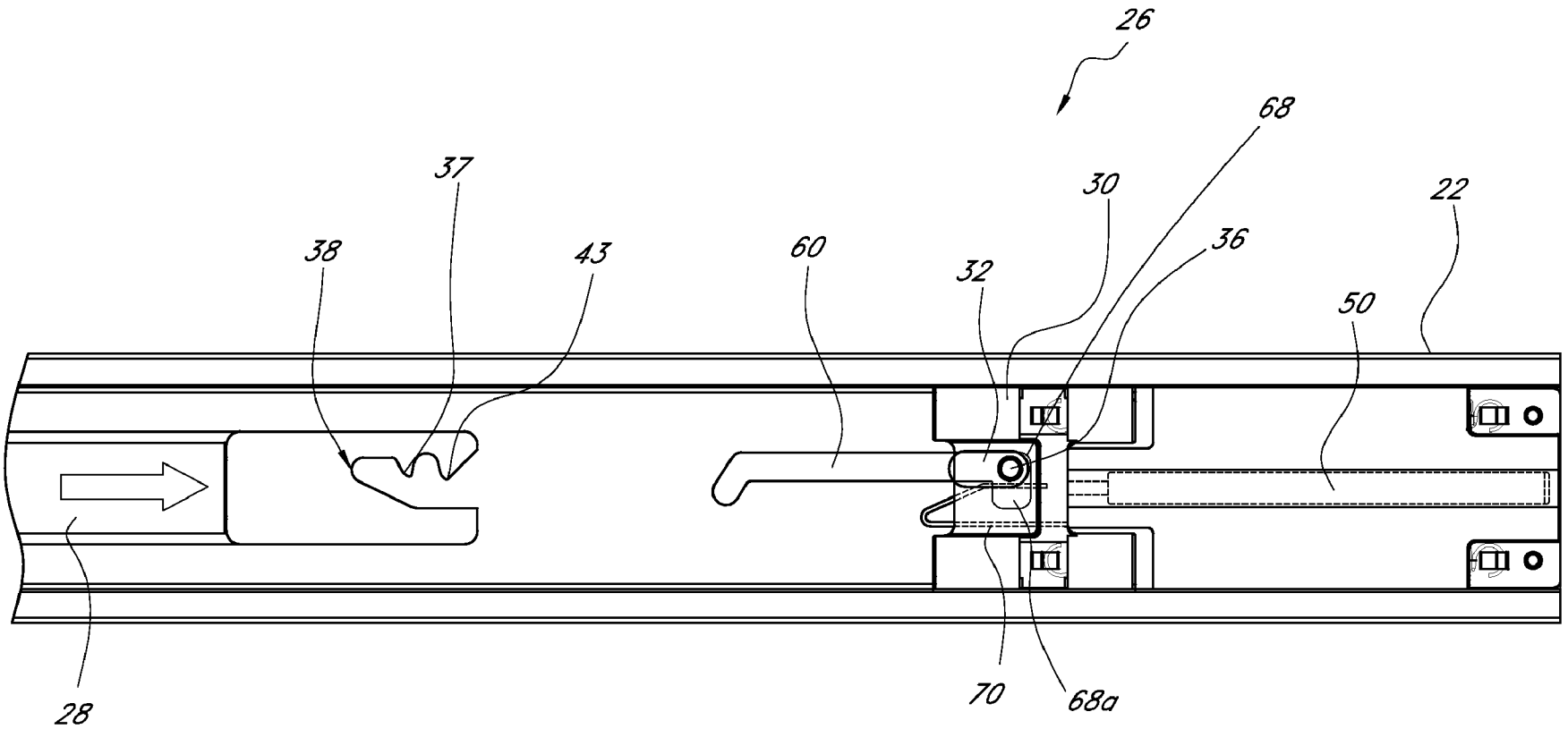
FIGS. 6A-D illustrate the interaction between an inner slide segment and a self-closing mechanism in the slide assembly of FIGS. 1-4, during the resetting of the self-closing mechanism.

In certain embodiments, the self-closing mechanism 26 is configured to allow the pin 36 to be reset into engagement with the slot 38 in the event that it retracts without being released by the inner segment 28 or if it is engaged improperly. FIGS. 6A-D illustrate the interaction between the inner segment 28 and the self-closing mechanism 26 during the resetting of the closing mechanism 26. Preferably, the self-closing mechanism 26 is configured so that the carrier 30 and latch 32 can be reset to the "set" position in the event the carrier 30 unintentionally retracts, while still permitting operation of the slide assembly 20. FIG. 6A illustrates the self-closing mechanism 26 in an unintentionally retracted state. The pin 36 of the latch 32 has moved through the linear portion of the guide slot 60 and is located at the end portion 68 of the guide slot 60. The carrier 30 is in the retracted position and the inner segment 28 is in an open or extended position. Preferably, the end portion 68 of the guide slot 60 includes a recess 68*a* which extends in a direction having at least a component perpendicular to the linear portion of the guide slot 60 and the longitudinal axis of the slide assembly 20. A spring 70 is positioned adjacent to the recess 68*a* of the guide slot 60 and resists downward movement of the pin 36 when it is in the end portion 68. Preferably, the spring 70 is configured to extend between the pin 36 and the downwardly extending recess 68*a* of the end portion 68, as illustrated in FIG. 6A.

Figure 6B:
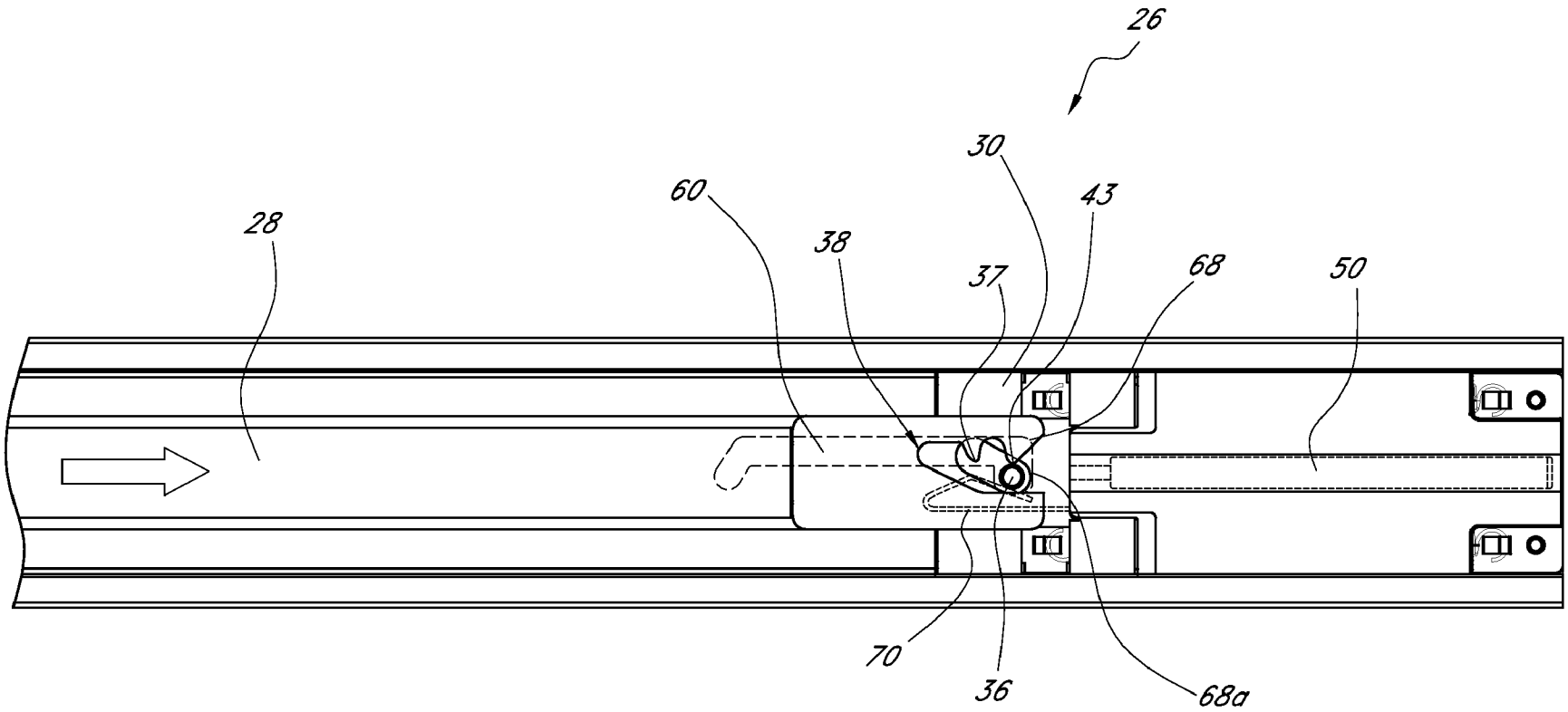
Figure 6C:
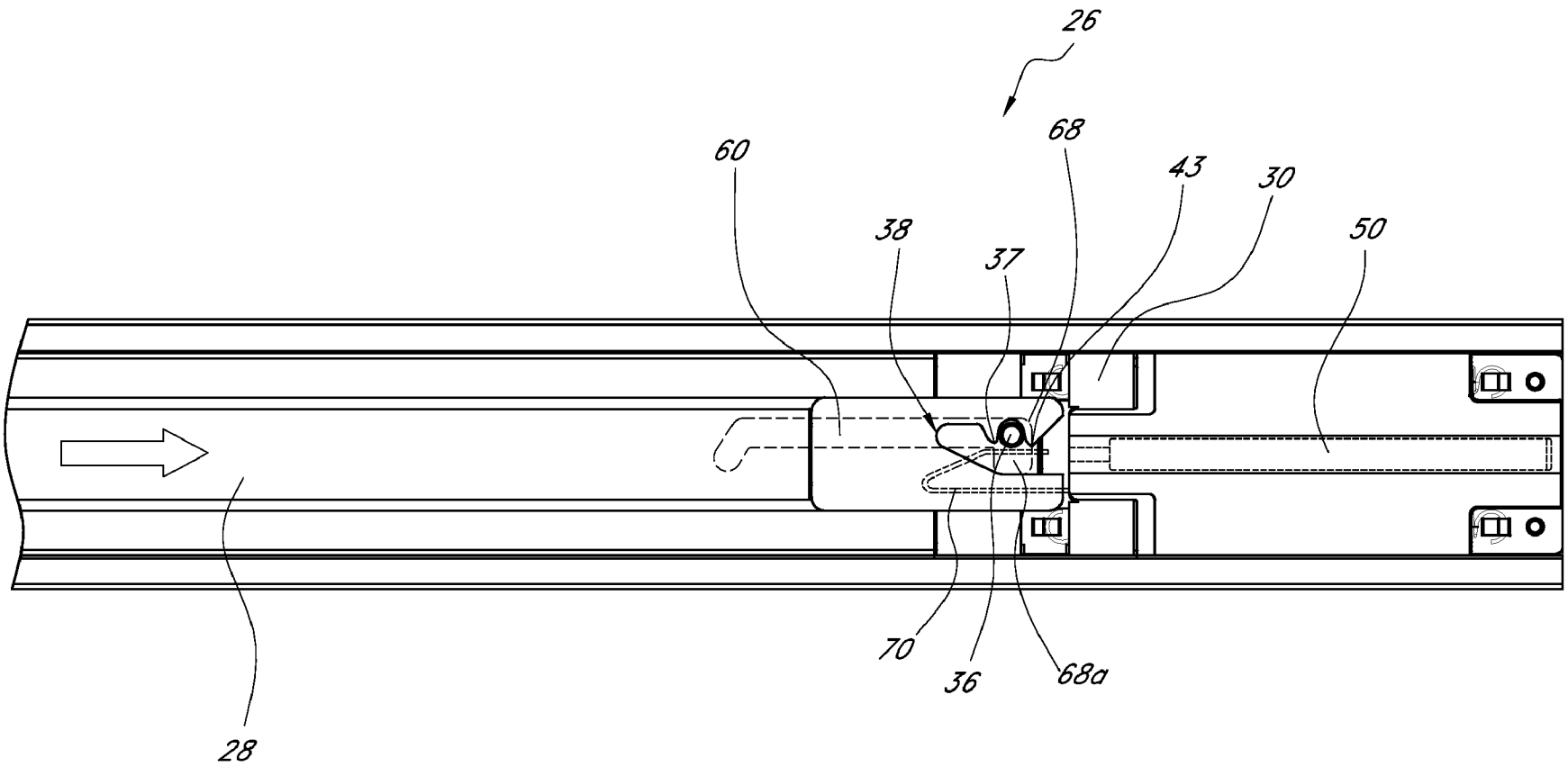

To reset the self-closing mechanism 26 and return the latch carrier to the "set" position, the inner segment 28 is moved in the closing direction towards the rearward end of the outer segment 22 until it engages the pin 36. The second tooth 43 of the slot 38 engages the pin 36 and as the inner segment 28 moves further towards the rearward end of the outer segment 22, the second tooth 43 forces the pin 36 downward into the recess 68*a* of the end portion 68 of the guide slot 60, as shown in FIG. 6B. The second tooth 43 pushes the pin 36 downward against the spring 70 and causes the spring 70 to deform or bend in order to allow the pin 36 to enter the recess 68*a* of the end portion 68. As the inner segment 28 continues to move toward the rearward end of the outer segment 22, the second tooth 43 moves past the displaced pin 36 and the pin 36 enters a space or groove between the second tooth 43 and the first tooth 37, as shown in FIG. 6C. When the pin 36 passes under the second tooth 43, the spring 70 urges the pin 36 upward and into the groove.

Figure 6D:
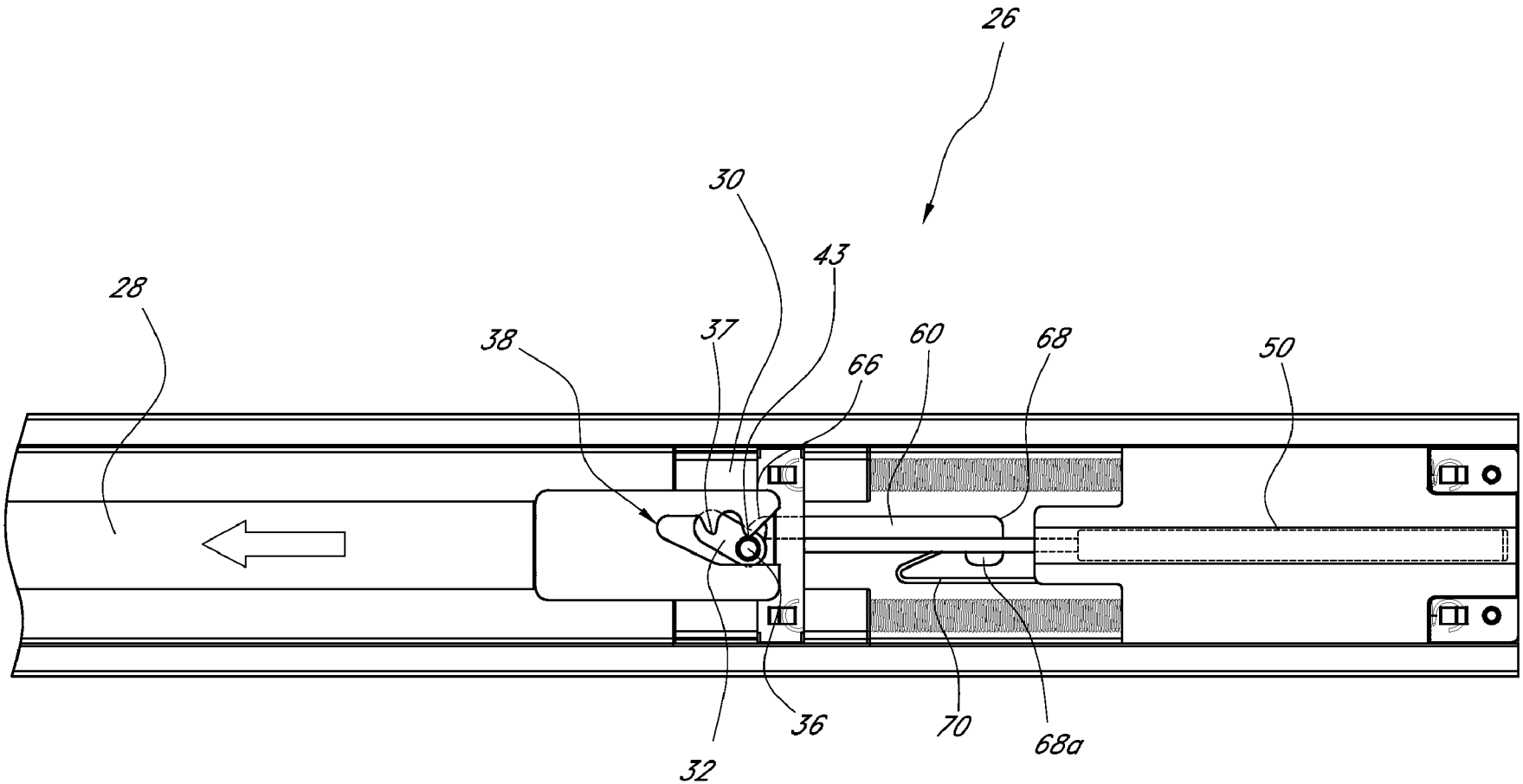

Preferably, the second tooth 43 is configured so that when the pin 36 is engaged within the groove between the first tooth 37 and the second tooth 43, the pin 36 is carried by the second tooth 43 along the guide slot 60 as the inner segment 28 is moved away from the rearward end of the outer segment 22 as the slide assembly 20 is opened. With the pin 36 in the groove and engaged by the second tooth 43, the inner segment 28 moves away from the rearward end of the outer segment 22 and the pin 36 moves toward the locking portion 66 of the guide slot 60. As the inner segment 28 moves further towards the open position, the pin 36 moves down into the locking portion 66, as shown in FIG. 6D. Preferably, the second tooth 43 and/or the shape of the guide slot 60 cause the pin to move into the locking portion 66. With the pin 36 in the locking portion 66, the latch 32 and carrier 30 are in the "set" position and the self-closing mechanism 26 is ready to be re-engaged as described above with reference to FIGS. 5A-F.

FIGS. 7A-F illustrate an alternative embodiment of a slide assembly with a self-closing mechanism 126. The embodiment of FIGS. 7A-F is similar to the embodiment described above, except the inner slide segment 128 includes a slot 138 having a single tooth 137. Other features not specifically described below can be assumed to be similar or identical to the corresponding features described above with reference to FIGS. 1-6, or of an otherwise suitable construction.

Figure 7A:
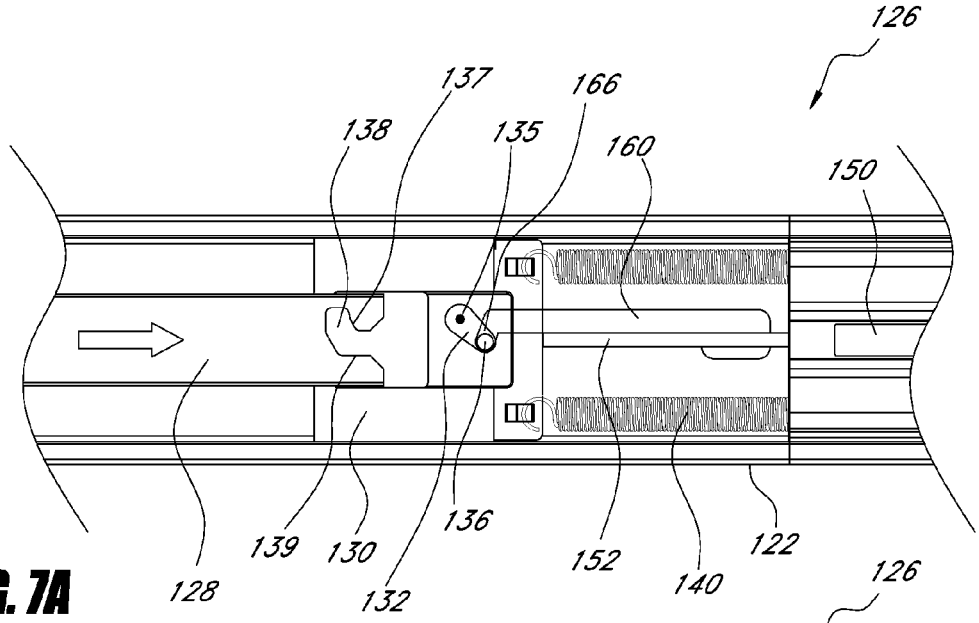
FIGS. 7A-F illustrate the interaction between an inner slide segment and a self-closing mechanism in and additional embodiment of a slide assembly, during opening and closing of the slide assembly.

The slot 138 includes an engagement surface 139 that is at least partially defined by the tooth or hook portion 137. A carrier 130 is slidably supported by an outer segment 122 and includes latch 132. The latch 132 includes a pin 136 and is rotatably supported by the carrier 130 about the axis 135. The wall portion of the outer segment 122 includes a guide slot 160 with a locking portion 166 at the forward end. A pair of springs 140 are supported by the outer segment 122 and coupled to the carrier 130. A dampener 150 is also supported by the outer segment 122 and includes a dampener rod 152 that is operably coupled to the carrier 130. FIGS. 7A-F show the self-closing mechanism 126 and the inner segment 128 in several relative positions during the opening/closing process labeled A-F. In FIG. 7A a latch 132 is biased in a "set" position. With the inner segment 128 and the slot 138 pulled away from the latch 132, the pin 136 remains in the locking portion 166 of the guide slot 160 and the latch carrier 130 and dampener 150 is in an extended position. In the illustrated "set" position, the springs 140 are in tension.

Figure 7B:
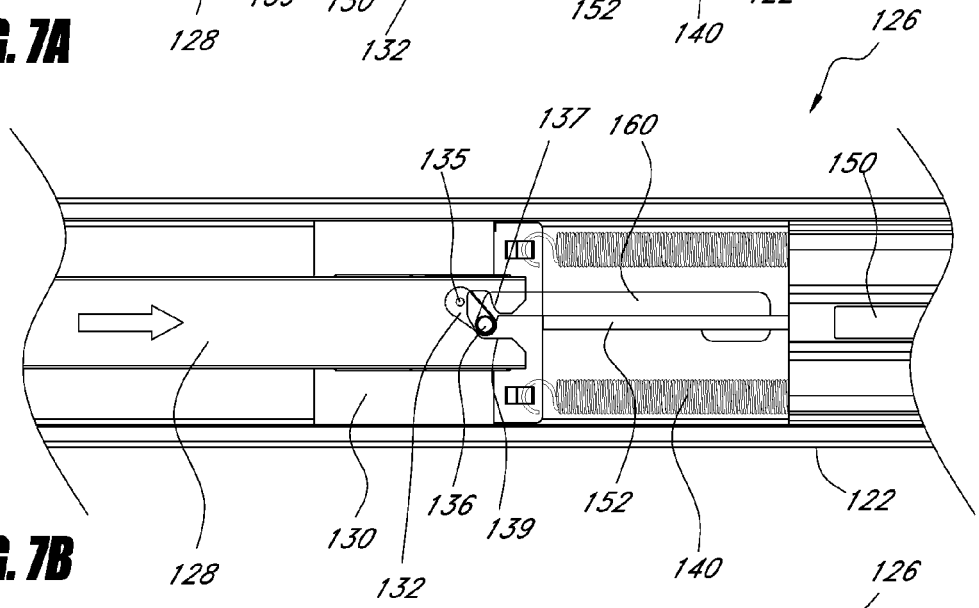
Figure 7C:
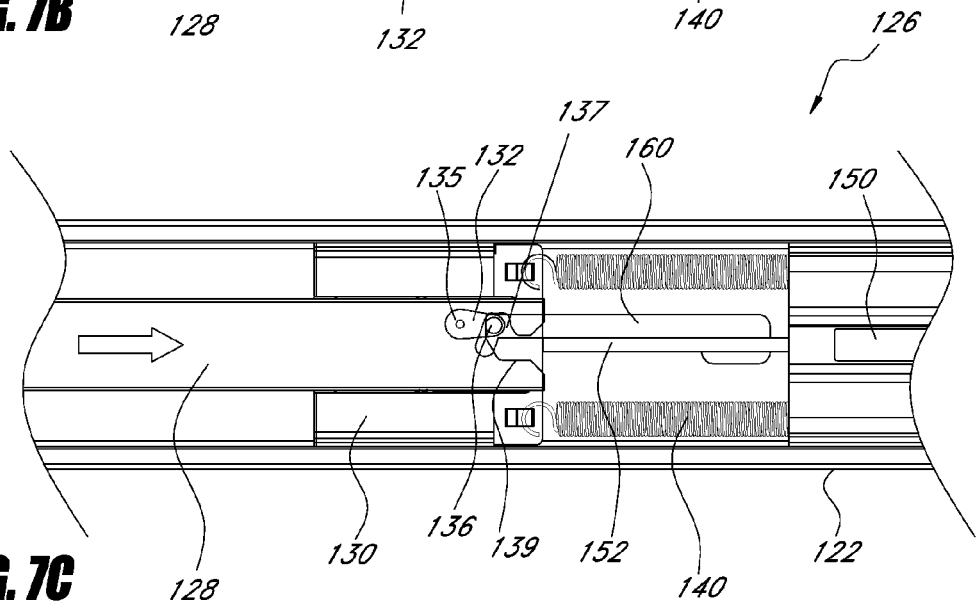
Figure 7D:
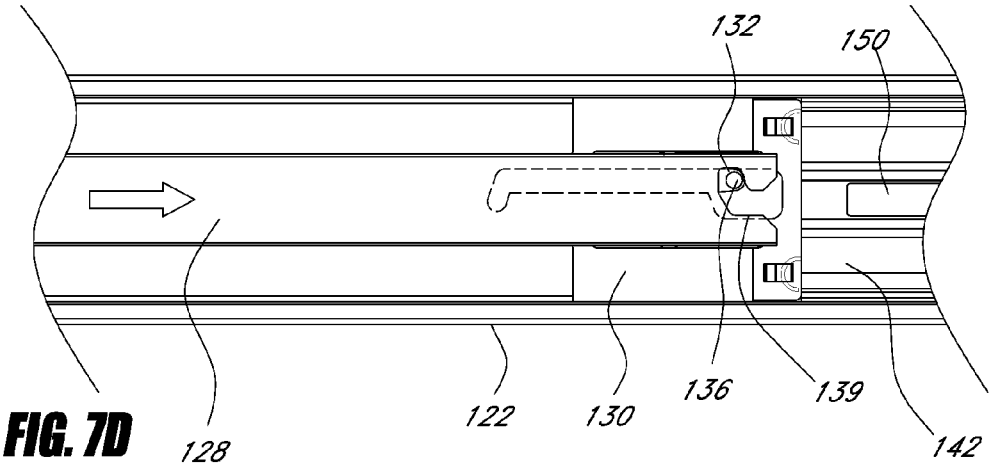

The inner segment 128 is pushed in a closing direction into the outer segment 122 until it engages and moves the latch 132 which begins the self-closing operation. As the inner segment 128 is pushed toward the rearward end of the outer segment 122, the pin 136 enters the slot 138, as shown in FIG. 7B. Preferably, the pin 136 is below (in the orientation of FIG. 7B) the axis 135 of the latch 132. As the inner segment 128 is pushed in a closing direction towards the rearward end of the outer segment 122, the engagement surface 139 of the slot 138 and/or the shape of the slot 138 forces the pin 136 upward and out of the locking portion 166 of the guide slot 160. The pin 136 is then moved into a position in which it can slide within the linear portion of the guide slot 160, as shown in FIG. 7C. Then the tensioned springs 140 pull the latch carrier 130 toward the rearward end of the outer segment 122 and the dampener rod 152 slides further into the dampener 150 causing a dampening force to be produced. The inner segment 128 moves toward the rearward end of the outer segment 122 as the pin 136 engages the tooth or hook portion 137 of the inner segment 128. As the pin 136 moves towards the dampener mount 142 and the end of the outer segment 122, it pulls the inner segment 128 along with it. The springs 140 pull the latch carrier 130 and move the pin 136 until the inner segment 128 has reached its fully closed position, as illustrated in FIG. 7D.

In the closed position, the springs 140 preferably remain in tension and provide a force tending to resist the latch carrier 130 and the inner segment 128 from moving in an opening direction towards an open position. Preferably, a portion of the guide slot 160 can be configured to assist in keeping the mechanism in the closed position.

Figure 7E:
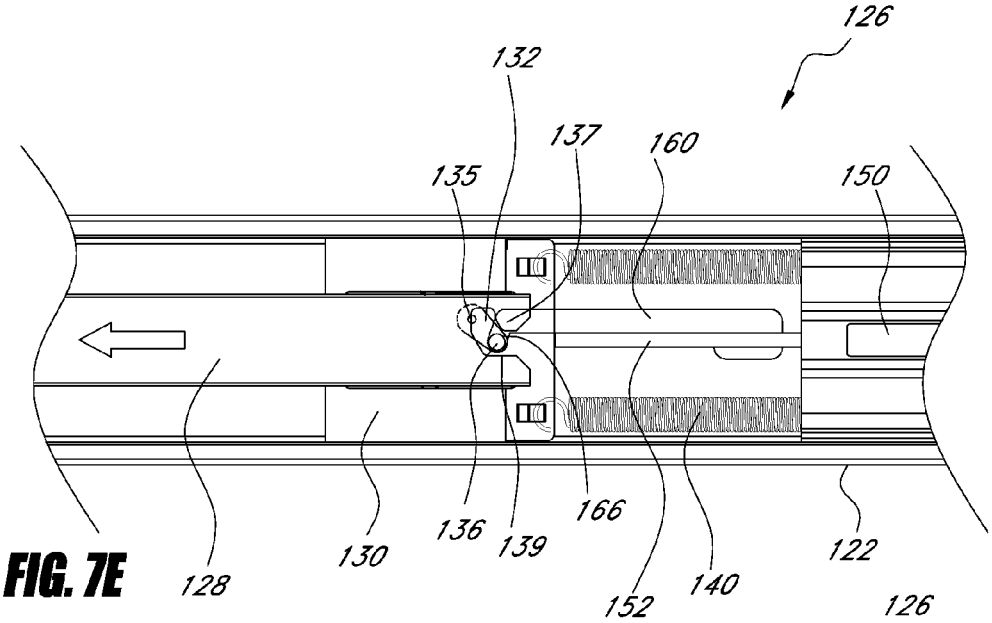

When a user opens the drawer or pulls the inner segment 128 away from the rearward end of the outer segment 122, the hook portion 137 of the inner segment 128 moves the pin 136 in the opening direction along the guide slot 160. As the pin 136 is moved through the guide slot 160, the latch carrier 130 is moved away from the rearward end of the outer segment 122 and the dampener 150 is extended and the springs 140 are stretched. During opening of a drawer, the inner segment 128 continues to move away from the rearward end of the outer segment 122 until the pin 136 reaches the locking portion 166 of the guide slot 160, as shown in FIG. 7E. The tooth or hook portion 137 of the inner segment 128 moves the pin 136 into the locking portion 166 as the pin 136 moves towards the opening of the slot 138.

Figure 7F:
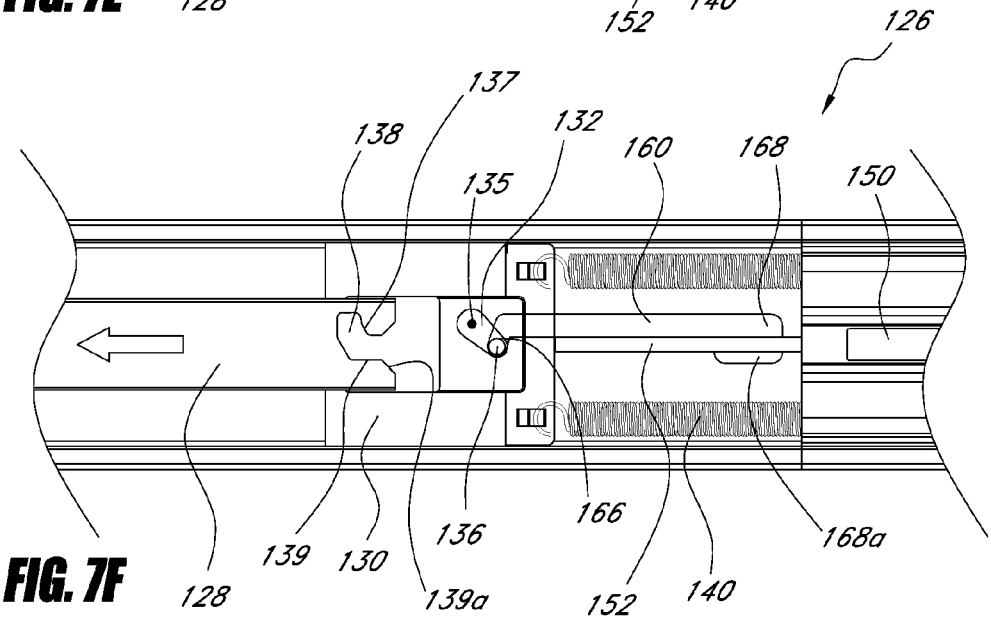

As the inner segment 128 is moved even further in the opening direction, the pin 136 slides out of the slot 138 and remains in the locking portion 166 of the guide slot 160, as shown in FIG. 7F. At this point, the self-closing mechanism 126 has reached the "set" position typically until engaged again by the inner segment 128. In this embodiment, the self-closing mechanism 126 can also be configured to allow the pin 136 to be reset into engagement with the slot 138 in the event that it retracts without being released by the inner segment 128 or if it is engaged improperly. In particular, the slot 138 includes a lower ramped surface portion 139*a* that is configured to lift the pin 136 from a recess 168*a* at a rearward end 168 of the guide slot 160.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A slide assembly comprising:

a first slide segment defining a wall portion and a pair of bearing surfaces spaced from one another on opposite sides of the wall portion;

a second slide segment operably supported by the bearing surfaces of the first segment, the second slide segment being movable relative to the first slide segment between an extended position and a retracted position;

a self-closing mechanism coupled to the first slide segment and configured to automatically move the second slide segment in a closing direction towards the retracted position when the second segment is moved to within a predetermined distance from the retracted position, the self-closing mechanism comprising:

a carrier configured with surfaces that engage the bearing surfaces to support the carrier relative to the second slide segment, the carrier being movable relative to the first segment;

a pin carried by the carrier and rotatable relative to the carrier;

a pair of springs configured to urge the carrier in the closing direction;

a dampener coupled to the carrier and configured to produce a dampening force tending to oppose the movement of the carrier;

a guide slot defined by an opening passing completely through the wall of the first slide segment and having an edge surface of a portion of the wall that defines the opening configured to guide the movement of the pin;

an engagement surface defined by the second slide segment that releases the pin from a set position and engages the pin such that the second segment is moved along with the movement of the carrier towards a closed position as the carrier is urged by the springs against the dampening force of the dampener.

2. The slide assembly of claim 1, wherein the second slide segment comprises a first tooth defining a first portion of the engagement surface and configured to engage the pin during the normal closing motion of the self-closing mechanism.

3. The slide assembly of claim 2, wherein the second slide segment further comprises a second tooth defining a second portion of the engagement surface and configured to assist in resetting the self-closing mechanism.

4. The slide assembly of claim 1, wherein the dampener is positioned between the springs.

5. The slide assembly of claim 1, further comprising a third slide segment operably supported by the bearing surfaces of the first slide segment and configured to operably support the second slide segment.

6. The slide assembly of claim 1, wherein the engagement surface is defined by a slot in the second slide segment that comprises a sloped portion configured to engage the pin and assist in removing the pin from the set position.

7. The slide assembly of claim 1, wherein the guide slot comprises a locking portion that extends in a direction having at least a component that is perpendicular with respect to the longitudinal axis of the slide assembly, the locking portion is configured to hold the pin in the set position.

8. The slide assembly of claim 1, wherein the pin is rotatably supported by the carrier.

9. The slide assembly of claim 1, wherein the slide assembly has a maximum width dimension of about 0.43 inches or less.

10. The slide assembly of claim 1, wherein the engagement surface of the second slide segment is defined by a slot passing completely through the second slide segment and opening to a rearward edge of the second slide segment.

11. The slide assembly of claim 1, wherein the dampener comprises a dampener cylinder and a dampener rod that move relative to one another in a linear direction.

12. A slide assembly compromising:

a first slide segment defining a wall portion and a pair of bearing surfaces spaced from one another on opposite sides of the wall portion;

a second slide segment operably supported by the bearing surfaces of the first segment, the second slide segment being movable relative to the first slide segment between an extended position and a retracted position;

a self-closing mechanism coupled to the first slide segment and configured to automatically move the second slide segment in a closing direction towards the retracted position when the second segment is moved to within a predetermined distance from the retracted position, the self-closing mechanism comprising:

a carrier configured with surfaces that engage the bearing surfaces to support the carrier relative to the second slide segment, the carrier being movable relative to the first segment a pin carried by the carrier and rotatable relative to the carrier;

a pair of springs configured to urge the carrier in the closing direction;

a dampener coupled to the carrier and configured to produce a dampening force tending to oppose the movement of the carrier;

a guide slot defined by the wall of the first slide segment and configured to guide the movement of the pin;

an engagement surface defined by the second slide segment that releases the pin from a set position and engages the pin such that the second segment is moved along with the movement of the carrier towards a closed position as the carrier is urged by the springs against the dampening force of the dampener;

wherein the guide slot further comprises a spring located at the end of the guide slot and configured to allow the pin to move into a recess of the guide slot to permit a portion of the second slide segment to pass over the pin.

13. A slide assembly, comprising:

an outer slide segment defining a wall portion and a pair of bearing surfaces spaced from one another on opposite sides of the wall portion;

an inner slide segment operably supported by the bearing surfaces of the outer segment, the inner slide segment being movable relative to the outer slide segment between an open position and a closed position;

a self-closing mechanism coupled to the outer slide segment and configured to automatically move the inner slide segment in a closing direction towards the closed position when the inner segment is moved to within a predetermined distance from the closed position, the self-closing mechanism comprising:

a carrier that is slidably supported relative to the outer slide segment by the bearing surfaces;

a latch carried by the carrier, wherein the latch selectively engages the inner slide segment such that the carrier and the inner slide segment move together relative to the outer slide segment;

a biasing mechanism configured to urge the carrier in the closing direction;

a dampener configured to produce a dampening force tending to oppose movement of the carrier;

a guide slot defined by an opening passing completely through the wall of the outer slide segment and having an edge surface of a portion of the wall that defines the opening configured to assist in engagement and disengagement of the latch from the inner slide segment.

14. The slide assembly of claim 13, wherein the biasing mechanism of the self-closing mechanism comprises two springs and the dampener is positioned between the two springs.

15. The slide assembly of claim 13, wherein the inner segment includes a slot and the latch comprises a movable pin configured to engage the slot.

16. The slide assembly of claim 15, wherein the slot in the inner segment comprises a tooth configured for resetting the pin to a set position.

17. The slide assembly of claim 15, wherein the slot of the inner slide segment is defined by a slot passing completely through the inner slide segment and opening to a rearward edge of the inner slide segment.

18. The slide assembly of claim 13, wherein the slide assembly has a maximum width dimension of about 0.43 inches or less.

19. The slide assembly of claim 13, wherein the dampener comprises a dampener cylinder and a dampener rod that move relative to one another in a linear direction.

20. A slide assembly comprising:

a first slide segment defining at least one bearing surface;

a second slide segment operably supported by the bearing surface of the first slide segment, the second slide segment configured to move relative to the first slide segment between a closed position and an open position;

a self-closing mechanism configured to automatically move the second slide segment in a closing direction towards the closed position when the second segment is moved to within a predetermined distance from the closed position, the self-closing mechanism including a carrier configured to engage the second slide segment and a dampener configured to dampen the motion of the carrier, wherein the second slide segment comprises a slot and the carrier comprises a pin, the slot being configured to engage the pin, and the first slide segment comprises a guide slot defined by an opening passing completely through a wall of the first slide segment and having an edge surface of a portion of the wall that defines the opening configured to guide the movement of the pin;

wherein the carrier is slidably supported by the bearing surface of the first slide segment.

21. The slide assembly of claim 20, wherein the self-closing mechanism further comprises a pair of springs configured to urge the carrier towards the fully closed position and the dampener is positioned between the springs.

22. The slide assembly of claim 20, further comprising a third slide segment operably supported by the bearing surfaces of the first slide segment and configured to operably support the second slide segment.

23. The slide assembly of claim 20, wherein the slot of the second slide segment passes completely through the second slide segment and defines an opening to a rearward edge of the second slide segment.

24. The slide assembly of claim 20, wherein the dampener comprises a dampener cylinder and a dampener rod that move relative to one another in a linear direction.

* * * * *